US012808612B2

(12) United States Patent
Kondo et al.

(10) Patent No.: US 12,808,612 B2
(45) Date of Patent: Nov. 24, 2026

(54) HEAT EXCHANGER UNIT, HEADER PART, AND METHOD FOR MANUFACTURING HEADER PART

(71) Applicant: MITSUBISHI HEAVY INDUSTRIES, LTD., Tokyo (JP)

(72) Inventors: Yoshiyuki Kondo, Tokyo (JP); Hiroaki Nakanishi, Tokyo (JP); Yoshiteru Komuro, Tokyo (JP); Koichi Tanimoto, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 126 days.

(21) Appl. No.: 18/865,608

(22) PCT Filed: Feb. 20, 2023

(86) PCT No.: PCT/JP2023/005950
§ 371 (c)(1),
(2) Date: Nov. 13, 2024

(87) PCT Pub. No.: WO2023/223620
PCT Pub. Date: Nov. 23, 2023

(65) Prior Publication Data

US 2026/0194310 A1 Jul. 9, 2026

(30) Foreign Application Priority Data

May 19, 2022 (JP) ..... 2022-082119

(51) Int. Cl.
*F28F 9/02* (2006.01)

(52) U.S. Cl.
CPC ..... *F28F 9/02* (2013.01); *F28F 9/0275* (2013.01); *F28F 9/0278* (2013.01); *F28F 2210/02* (2013.01)

(58) Field of Classification Search
CPC ..... F28F 7/02; F28F 2210/02; F28F 9/0275; F28F 9/0278
See application file for complete search history.

(56) References Cited

U.S. PATENT DOCUMENTS

2013/0206374 A1* 8/2013 Roisin ..... F28D 7/0041 165/165
2013/0264031 A1 10/2013 Plourde et al.
(Continued)

FOREIGN PATENT DOCUMENTS

DE 102017007922 A1 * 2/2019 ..... F28F 7/02
EP 3 499 169 A1 6/2019
(Continued)

OTHER PUBLICATIONS

International Search Report and Written Opinion of the International Searching Authority for International Application No. PCT/JP2023/005950, dated Apr. 4, 2023, with English translation.

*Primary Examiner* — Eric S Ruppert
(74) *Attorney, Agent, or Firm* — Birch, Stewart, Kolasch & Birch, LLP

(57) ABSTRACT

This header member comprises a first flow channel portion disposed between end portions of a plurality of first heat transfer pipes of a heat exchanger and a first external pipe connecting portion, and a second flow channel portion disposed between end portions of a plurality of second heat transfer pipes of the heat exchanger and a second external pipe connecting portion, wherein: the first flow channel portion includes a plurality of first flow channels joined respectively to the plurality of first heat transfer pipes; the plurality of first flow channels are connected successively in a stepwise manner and are connected to one first external pipe connecting portion; the second flow channel portion includes a plurality of second flow channels which are joined respectively to the plurality of second heat transfer
(Continued)

pipes and which are formed independently of the plurality of first flow channels; and the plurality of second flow channels are connected successively in a stepwise manner and are connected to one second external pipe connecting portion.

8 Claims, 14 Drawing Sheets

(56) References Cited

U.S. PATENT DOCUMENTS

| | | | | |
|---|---|---|---|---|
| 2017/0328644 | A1* | 11/2017 | Takahashi | F28F 3/00 |
| 2020/0284532 | A1 | 9/2020 | Becene et al. | |
| 2021/0102756 | A1 | 4/2021 | Becene et al. | |
| 2021/0154779 | A1 | 5/2021 | Norman | |
| 2022/0234013 | A1 | 7/2022 | Patel et al. | |

FOREIGN PATENT DOCUMENTS

| | | | |
|---|---|---|---|
| JP | 2016-90157 | A | 5/2016 |
| JP | 2020-517431 | A | 6/2020 |
| JP | 6840262 | B2 | 3/2021 |

* cited by examiner

HEAT EXCHANGER UNIT, HEADER PART, AND METHOD FOR MANUFACTURING HEADER PART

TECHNICAL FIELD

The present disclosure relates to a header part, a heat exchanger unit, and a method for manufacturing a header part.

Priority is claimed on Japanese Patent Application No. 2022-082119, filed May 19, 2022, the content of which is incorporated herein by reference.

BACKGROUND ART

In a heat exchanger, there is a heat exchanger in which a plurality of heat transfer pipes through which a fluid flows are arranged in parallel. PTL 1 discloses a configuration of a header of a heat exchanger, the header including a distribution flow channel for distributing a flow channel into a plurality of flow channels from a refrigerant inflow portion to a plurality of heat transfer pipes.

CITATION LIST

Patent Literature

[PTL 1] Japanese Patent No. 6840262

SUMMARY OF INVENTION

Technical Problem

Meanwhile, there is a heat exchanger having a configuration in which a plurality of first heat transfer pipes through which a first fluid flows and a plurality of second heat transfer pipes through which a second fluid flows are bundled to be adjacent to each other. In the heat exchanger having such a configuration, it is necessary to distribute the first fluid and the second fluid to each of the plurality of first heat transfer pipes and the plurality of second heat transfer pipes in a header on an inflow side with respect to the heat exchanger. In addition, in a header on an outflow side from the heat exchanger, it is necessary to merge the first fluid and the second fluid flowing out from the plurality of first heat transfer pipes and the plurality of second heat transfer pipes, respectively. In this case, it is necessary to branch or converge the flow channel of the first fluid and the flow channel of the second fluid without intersecting the flow channel of the first fluid and the flow channel of the second fluid.

The present disclosure provides a header member, a heat exchanger unit, and a method for manufacturing a header member that can branch or converge a first fluid and a second fluid with a simple configuration without mixing the first fluid and the second fluid with respect to a heat exchanger having a configuration in which a plurality of first heat transfer pipes and a plurality of second heat transfer pipes are disposed to be adjacent to each other.

Solution to Problem

According to the present disclosure, there is provided a header member that is attached to a heat exchanger in which a plurality of first heat transfer pipes through which a first fluid flows and a plurality of second heat transfer pipes through which a second fluid different from the first fluid flows are disposed to be adjacent to each other, the header member including: one first external pipe connecting portion that is disposed at a position away from an end portion of the heat exchanger and to which a first external pipe for supplying or discharging the first fluid to or from the heat exchanger is connectable; a first flow channel portion that is disposed between end portions of the plurality of first heat transfer pipes and the first external pipe connecting portion; one second external pipe connecting portion that is disposed at a position away from the end portion of the heat exchanger and to which a second external pipe for supplying or discharging the second fluid to or from the heat exchanger is connectable; and a second flow channel portion that is disposed between end portions of the plurality of second heat transfer pipes and the second external pipe connecting portion, in which the first flow channel portion includes a plurality of first flow channels coupled respectively to the plurality of first heat transfer pipes, the plurality of first flow channels are sequentially connected in a stepwise manner and are connected to the one first external pipe connecting portion, the second flow channel portion includes a plurality of second flow channels coupled respectively to the plurality of second heat transfer pipes and formed independently of the plurality of first flow channels, and the plurality of second flow channels are sequentially connected in a stepwise manner and are connected to the one second external pipe connecting portion.

According to the present disclosure, there is provided a heat exchanger unit including: a heat exchanger that includes a plurality of first heat transfer pipes through which a first fluid flows and a plurality of second heat transfer pipes through which a second fluid flows; and the header member as described above that is disposed at at least one end portion of the heat exchanger.

According to the present disclosure, there is provided a method for manufacturing the header member as described above, including: a step of acquiring information regarding a flow rate distribution of the first fluid among the plurality of first flow channels in the first flow channel portion and a flow rate distribution of the second fluid among the plurality of second flow channels in the second flow channel portion; a step of determining shapes of the first flow channel and the second flow channel such that flow resistance is constant, based on the acquired information regarding the flow rate distribution of the first fluid among the plurality of first flow channels and the flow rate distribution of the second fluid among the plurality of second flow channels; a step of forming the first flow channel portion and the second flow channel portion based on the determined shapes of the first flow channel and the second flow channel; a step of forming the first external pipe connecting portion and the second external pipe connecting portion; and a step of connecting the formed first external pipe connecting portion, first flow channel portion, second external pipe connecting portion, and second flow channel portion to manufacture the header member.

Advantageous Effects of Invention

With the header member, the heat exchanger unit, and the method for manufacturing a header member of the present disclosure, it is possible to branch or converge the first fluid and the second fluid with a simple configuration without mixing the first fluid and the second fluid with respect to a heat exchanger having a configuration in which a plurality of first heat transfer pipes and a plurality of second heat transfer pipes are disposed to be adjacent to each other.

DESCRIPTION OF EMBODIMENTS

Hereinafter, embodiments of a header member, a heat exchanger unit, and a method for manufacturing a header member according to the present disclosure will be described with reference to the accompanying drawings. However, the present disclosure is not limited only to these embodiments.

First Embodiment (Configuration of Heat Exchanger Unit)

Figure 1:
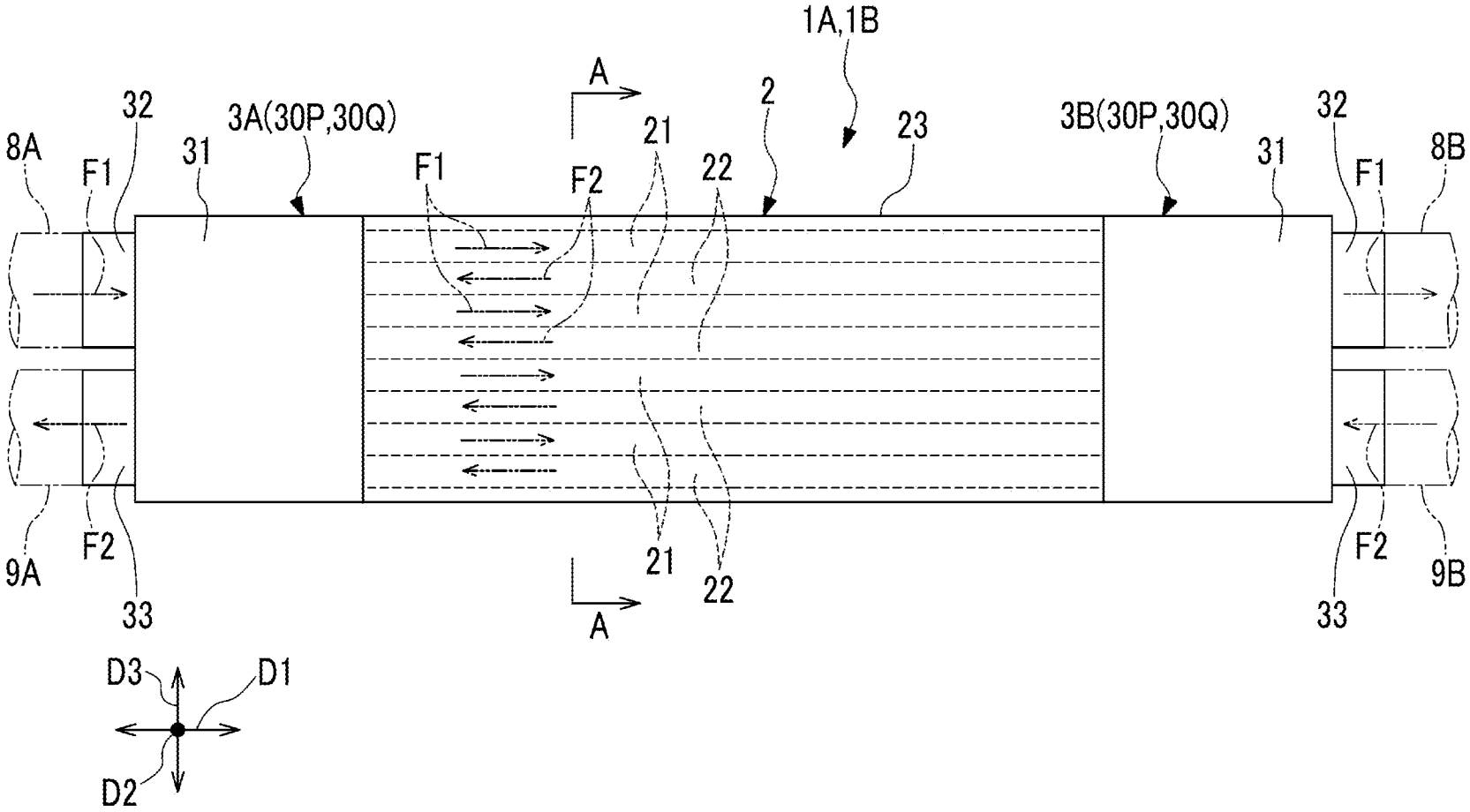
FIG. 1 is a diagram showing a schematic configuration of a heat exchanger unit including a header member according to an embodiment of the present disclosure.

A heat exchanger unit TA is disposed in the middle of a pipe or the like and is capable of exchanging heat between fluids having different temperatures. As shown in FIG. 1, the heat exchanger unit 1A includes a heat exchanger 2, a first header 3A, and a second header 3B.

(Configuration of Heat Exchanger)

The heat exchanger 2 exchanges heat between a supplied first fluid F1 and a supplied second fluid F2. The first fluid F1 and the second fluid F2 are different fluids. The first fluid F1 and the second fluid F2 are each a gas or a liquid. The first fluid F1 and the second fluid F2 have at least different temperatures. The first fluid F1 and the second fluid F2 may differ not only in the temperature but also, for example, in the type of fluid.

Figure 2:
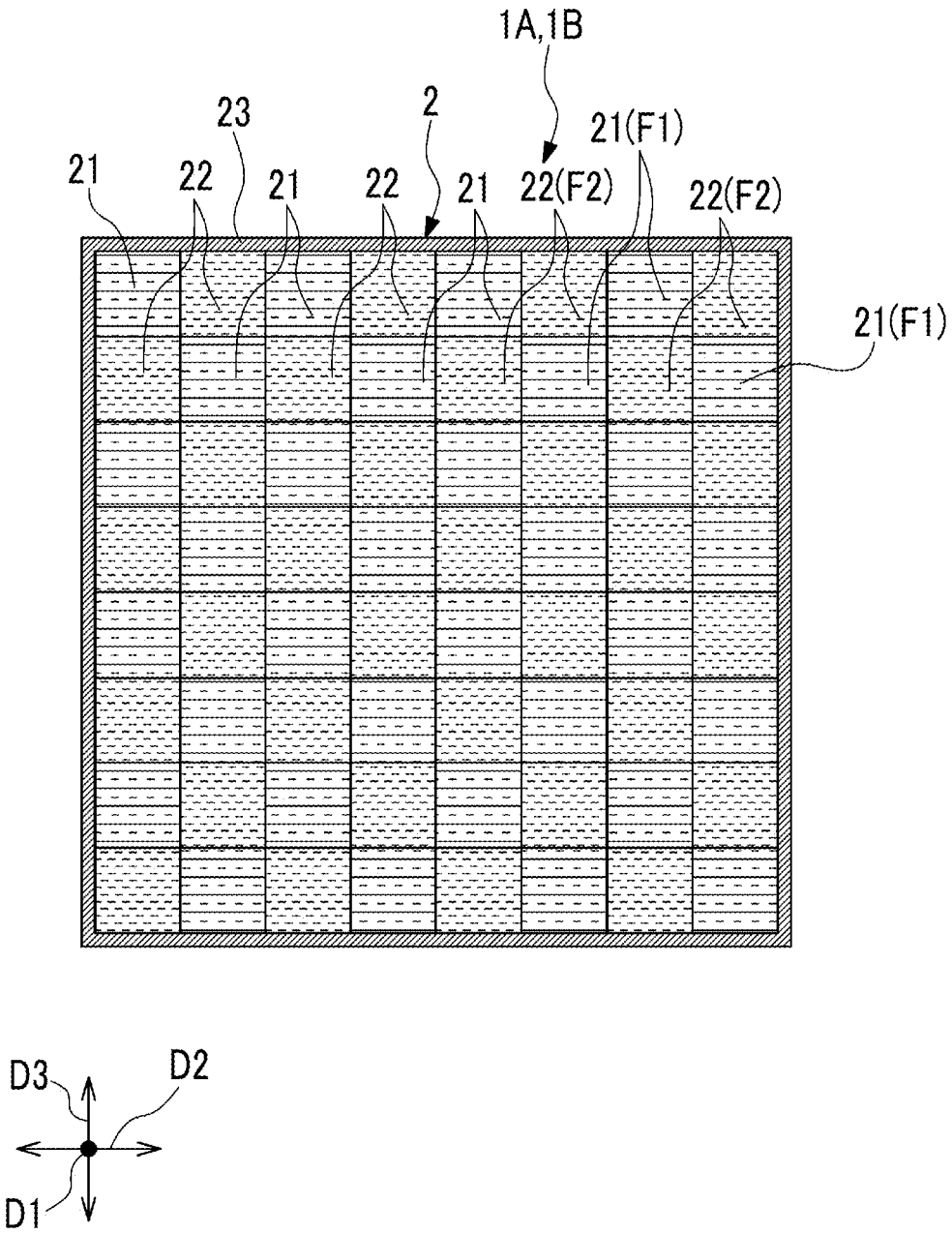
FIG. 2 is a cross-sectional view taken along line A-A of FIG. 1.

As shown in FIGS. 1 and 2, the heat exchanger 2 includes a plurality of first heat transfer pipes 21, a plurality of second heat transfer pipes 22, and a casing 23. Each of the plurality of first heat transfer pipes 21 and each of the plurality of second heat transfer pipes 22 extend in a first direction D1. The first heat transfer pipe 21 and the second heat transfer pipe 22 are each formed in a tubular shape extending in the first direction D1. That is, the first direction D1 is a direction in which the first heat transfer pipe 21 and the second heat transfer pipe 22 extend, and is a flow direction of the first fluid F1 and the second fluid F2 in the heat exchanger 2. The first heat transfer pipe 21 and the second heat transfer pipe 22 are open at both end portions in the first direction D1. In the present embodiment, the first heat transfer pipe 21 and the second heat transfer pipe 22 each have, for example, a rectangular (square) cross-sectional shape when viewed from the first direction D1. The first heat transfer pipe 21 and the second heat transfer pipe 22 are not limited to having a rectangular cross-sectional shape, and the cross-sectional shapes thereof when viewed from the first direction D1 may be, for example, circular, polygonal, or the like. The first heat transfer pipe 21 and the second heat transfer pipe 22 are each, for example, a tubular member formed of a metal material.

The plurality of first heat transfer pipes 21 and the plurality of second heat transfer pipes 22 are disposed to be adjacent to each other. In the present embodiment, the plurality of first heat transfer pipes 21 and the plurality of second heat transfer pipes 22 are disposed to be adjacent to each other in each of a second direction D2 orthogonal to the first direction D1 and a third direction D3 orthogonal to the first direction D1 and the second direction D2. In each of the second direction D2 and the third direction D3, the adjacent first heat transfer pipe 21 and second heat transfer pipe 22 are in contact with each other. That is, when viewed from the first direction D1, one first heat transfer pipe 21 is disposed in a state of being surrounded only by the plurality of second heat transfer pipes 22 without being adjacent to other first heat transfer pipes 21. The plurality of first heat transfer pipes 21 and the plurality of second heat transfer pipes 22 are disposed in the same number (for example, 32 each in the present embodiment). The number of the plurality of first heat transfer pipes 21 and the plurality of second heat transfer pipes 22 can be appropriately changed according to the environment in which the heat transfer pipes are used.

The second direction D2 is a width direction of the heat exchanger 2 and is, for example, a horizontal direction. In addition, the third direction D3 is a height direction of the heat exchanger 2 and is, for example, a vertical direction.

The plurality of first heat transfer pipes 21 and the plurality of second heat transfer pipes 22 are housed in the casing 23 in a bundled state. The casing 23 is formed in a tubular shape extending in the first direction D1. In the present embodiment, the casing 23 is formed in, for example, a rectangular cross-sectional shape as viewed from the first direction D1.

The first fluid F1 flows through each of the plurality of first heat transfer pipes 21. The second fluid F2 different from the first fluid F1 flows through each of the plurality of second heat transfer pipes 22. The flow direction of the first fluid F1 in the first heat transfer pipe 21 and the flow direction of the second fluid F2 in the second heat transfer pipe 22 may be the same direction or directions opposite to each other. In the present embodiment, the flow direction of the first fluid F1 in the first heat transfer pipe 21 and the flow direction of the second fluid F2 in the second heat transfer pipe 22 are, for example, opposite to each other in the first direction D1.

(Configuration of Header Member)

As shown in FIG. 1, the first header 3A and the second header 3B are attached to the heat exchanger 2. The first header 3A is attached to an end portion of the heat exchanger 2 on one side (first side) in the first direction D1. The second header 3B is attached to an end portion of the heat exchanger 2 on the other side (second side) in the first direction D1. That is, the second header 3B is disposed on an opposite side of the heat exchanger 2 from the first header 3A in the first direction D1. The second header 3B is disposed in a direction opposite to that of the first header 3A to face the first header 3A such that the second header 3B is symmetrical to the first header 3A with respect to the heat exchanger 2.

The first header 3A is disposed on an inflow side of the first fluid F1 with respect to the heat exchanger 2 and on an outflow side of the second fluid F2. One (single) first external pipe 8A and one (single) second external pipe 9A are connectable to the first header 3A. The first header 3A branches the first fluid F1 that has flowed through the one first external pipe 8A, and sends the first fluid F1 to the plurality of first heat transfer pipes 21. The first header 3A converges the second fluid F2 that has flowed through the plurality of second heat transfer pipes 22, and sends the second fluid F2 into the one second external pipe 9A.

The second header 3B is disposed on an outflow side of the first fluid F1 from the heat exchanger 2 and on an inflow side of the second fluid F2. One (single) first external pipe 8B and one (single) second external pipe 9B, which are different from those of the first header 3A, are connectable to the second header 3B. The second header 3B converges the first fluid F1 that has flowed through the plurality of first heat transfer pipes 21, and sends the first fluid F1 into the one first external pipe 8B. The second header 3B branches the second fluid F2 that has flowed through the one second external pipe 9B, and sends the second fluid F2 to the plurality of second heat transfer pipes 22.

Figure 3:
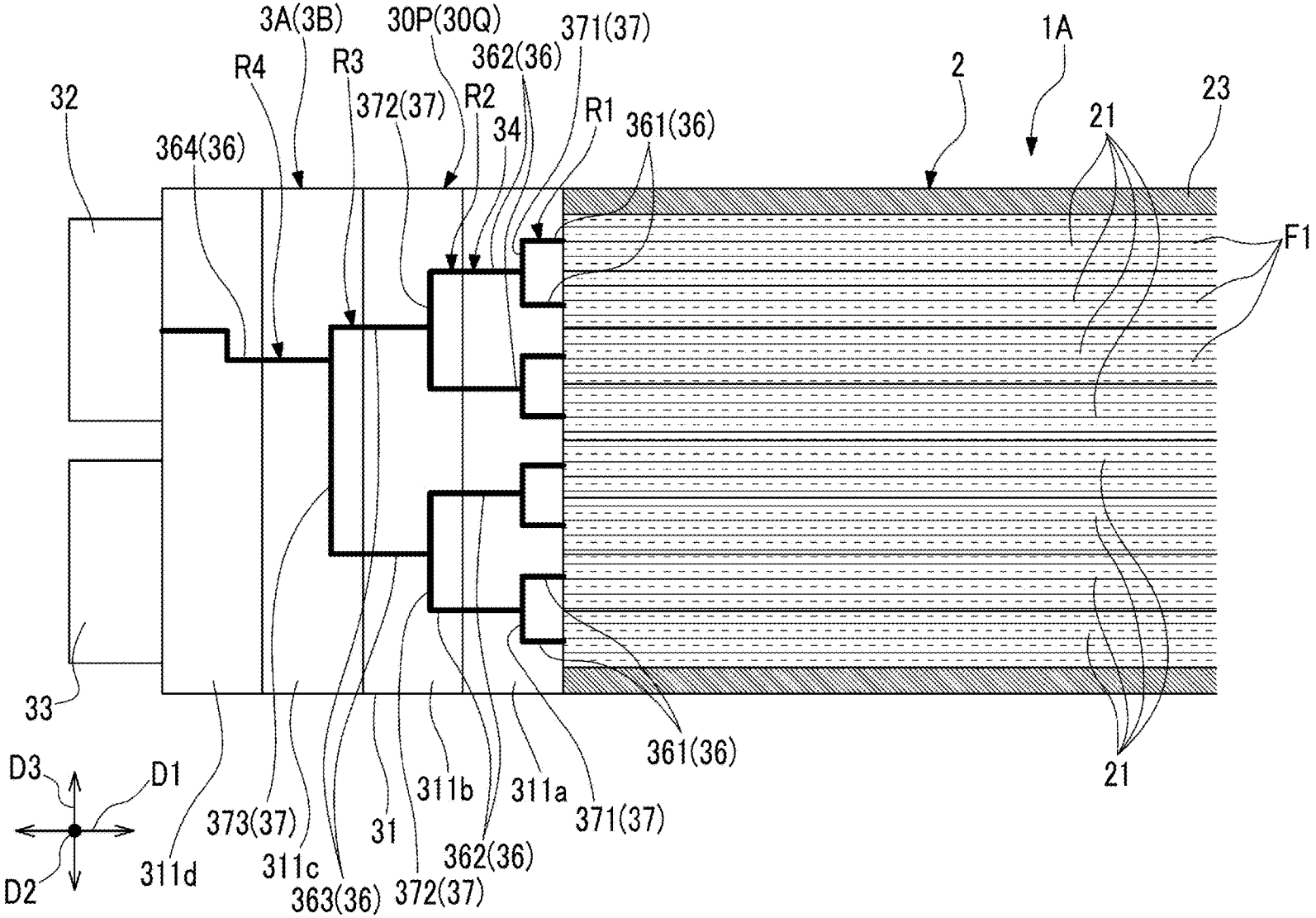
FIG. 3 is a diagram schematically showing a layout of first flow channels of a first flow channel portion in the above-described header member.

The first header 3A and the second header 3B are each configured by a header member 30P. Hereinafter, the header member 30P configuring the first header 3A and the second header 3B will be described. The header member 30P configuring the first header 3A and the header member 30P configuring the second header 3B have the same configuration, except that the header members 30P are disposed in different orientations and the flow directions of the first fluid F1 and the second fluid F2 are opposite to each other. As shown in FIG. 3, the header member 30P includes a header body 31, a first external pipe connecting portion 32, a second external pipe connecting portion 33, a first flow channel portion 34, and a second flow channel portion 35 (refer to FIG. 8).

The header body 31 is attached to the end portion of the heat exchanger 2 in the first direction D1. The header body 31 is attached to the heat exchanger 2 by using various joining means such as welding, adhesion, and bolting. The header body 31 is formed of the same material as the casing 23. The header body 31 is formed of, for example, a metal material, a ceramic material, a resin material, or the like. The header body 31 is formed in a rectangular (square) cross-section as viewed from the first direction D1. The header body 31 is formed in a shape of a rectangular parallelepiped extending in the first direction D1. In the present embodiment, the header body 31 is composed of a plurality of (in the present embodiment, for example, four) laminates 311*a* to 311*d* laminated in the first direction D1. The four laminates 311*a* to 311*d* are disposed in order to extend away from the end portion of the heat exchanger 2 in the first direction D1. Each of the laminates 311*a* to 311*d* is fixed to another adjacent one of the laminates 311*a* to 311*d* in the first direction D1. The laminate 311*a* disposed at a position closest to the heat exchanger 2 in the first direction D1 is fixed to the end portion of the heat exchanger 2.

The first external pipe connecting portion 32 is disposed in the header member 30P at a position away from the end portion of the heat exchanger 2 in the first direction D1. The first external pipe connecting portion 32 is fixed to the laminate 311*d* disposed at a position farthest from the end portion of the heat exchanger 2 in the first direction D1. Only one first external pipe connecting portion 32 is disposed in the header member 30P. The first external pipe 8A for supplying the first fluid F1 to the heat exchanger 2 or the first external pipe 8B for discharging the first fluid F1 from the heat exchanger 2 is connectable to the first external pipe connecting portion 32. The first external pipe connecting portion 32 includes, for example, a coupler, a screw joint, or the like that is detachable from the first external pipes 8A and 8B.

The second external pipe connecting portion 33 is disposed in the header member 30P at a position away from the end portion of the heat exchanger 2 in the first direction D1. The second external pipe connecting portion 33 is fixed to the laminate 311*d* at a position farthest from the end portion of the heat exchanger 2 in the first direction D1. Only one second external pipe connecting portion 33 is disposed in the header member 30P. The second external pipe connecting portion 33 is disposed to be spaced apart from the first external pipe connecting portion 32 in a direction intersecting the first direction D1. The second external pipe connecting portion 33 of the present embodiment is disposed at a position shifted from the first external pipe connecting portion 32 in the third direction D3. The second external pipe 9A for supplying the second fluid F2 to the heat exchanger 2 or the second external pipe 9B for discharging the first fluid F1 from the heat exchanger 2 is connectable to the second external pipe connecting portion 33. The second external pipe connecting portion 33 includes, for example, a coupler, a screw joint, or the like that is detachable from the second external pipes 9A and 9B.

The first flow channel portion 34 is disposed between open end portions of the plurality of first heat transfer pipes 21 and the first external pipe connecting portion 32. The first flow channel portion 34 includes a plurality of first flow channels 36 and a plurality of first flow channel connecting portions 37.

The plurality of first flow channels 36 are formed in the header body 31. More specifically, the plurality of first flow channels 36 of the present embodiment are formed by holes penetrating through insides of the laminates 311*a* to 311*d*. The plurality of first flow channels 36 are connected to the end portions of all the first heat transfer pipes 21 at positions close to the heat exchanger 2 in the first direction D1. The plurality of first flow channels 36 are sequentially connected in a stepwise manner and are connected to the one first external pipe connecting portion 32. That is, the plurality of first flow channels 36 are connected to the first external pipe connecting portion 32 at positions farthest from the heat exchanger 2 in the first direction D1.

The first flow channel portion 34 includes a plurality of flow channel sections R1 to R4. The plurality of first flow channels 36 are formed across the plurality of flow channel sections R1 to R4 in the first direction D1. The plurality of flow channel sections R1 to R4 are located in order in the first direction D1. Additionally, each of the flow channel sections R1 to R4 may be disposed to straddle the laminates 311*a* to 311*d* in the first direction. That is, two flow channel sections may be disposed in one of the laminates 311*a* to 311*d*. In the plurality of flow channel sections R1 to R4 of the first flow channel portion 34, the number of first flow channels 36 arranged in the second direction D2 decreases as a distance from the heat exchanger 2 increases in the first direction D1. In the present embodiment, in the plurality of flow channel sections R1 to R4 of the first flow channel portion 34, the number of first flow channels 36 arranged along a virtual plane, which spreads in the second direction D2 and the third direction when viewed from the first direction D1, decreases as the flow channel sections are farther from the heat exchanger 2.

Figure 4:
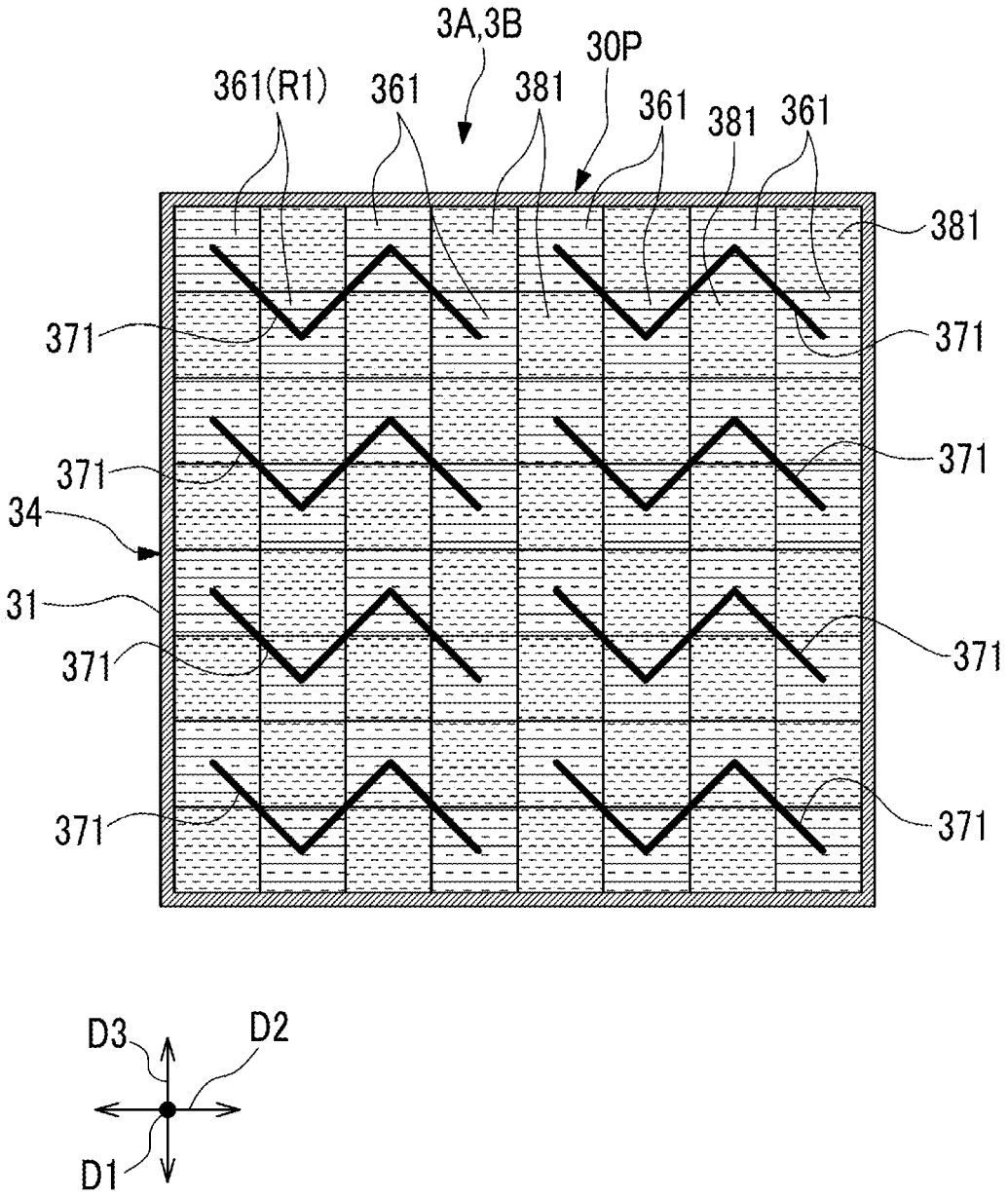
FIG. 4 is a diagram schematically showing a layout of a first flow channel connecting portion that connects a first flow channel of a first-stage flow channel section and a first flow channel of a second-stage flow channel section in the first flow channel portion of the above-described header member.

Specifically, among the plurality of flow channel sections R1 to R4, in the first-stage flow channel section R1, which is closest to the end portion of the heat exchanger 2, a primary first flow channel 361 of the plurality of first flow channels 36 is disposed. One primary first flow channel 361 is connected directly to one first heat transfer pipe 21. Therefore, as shown in FIG. 4, the primary first flow channel 361 in the first-stage flow channel section R1 is disposed in the same number as the first heat transfer pipes 21 when viewed from the first direction D1. That is, the primary first flow channel 361 has the largest number among the plurality of first flow channels 36.

Figure 5:
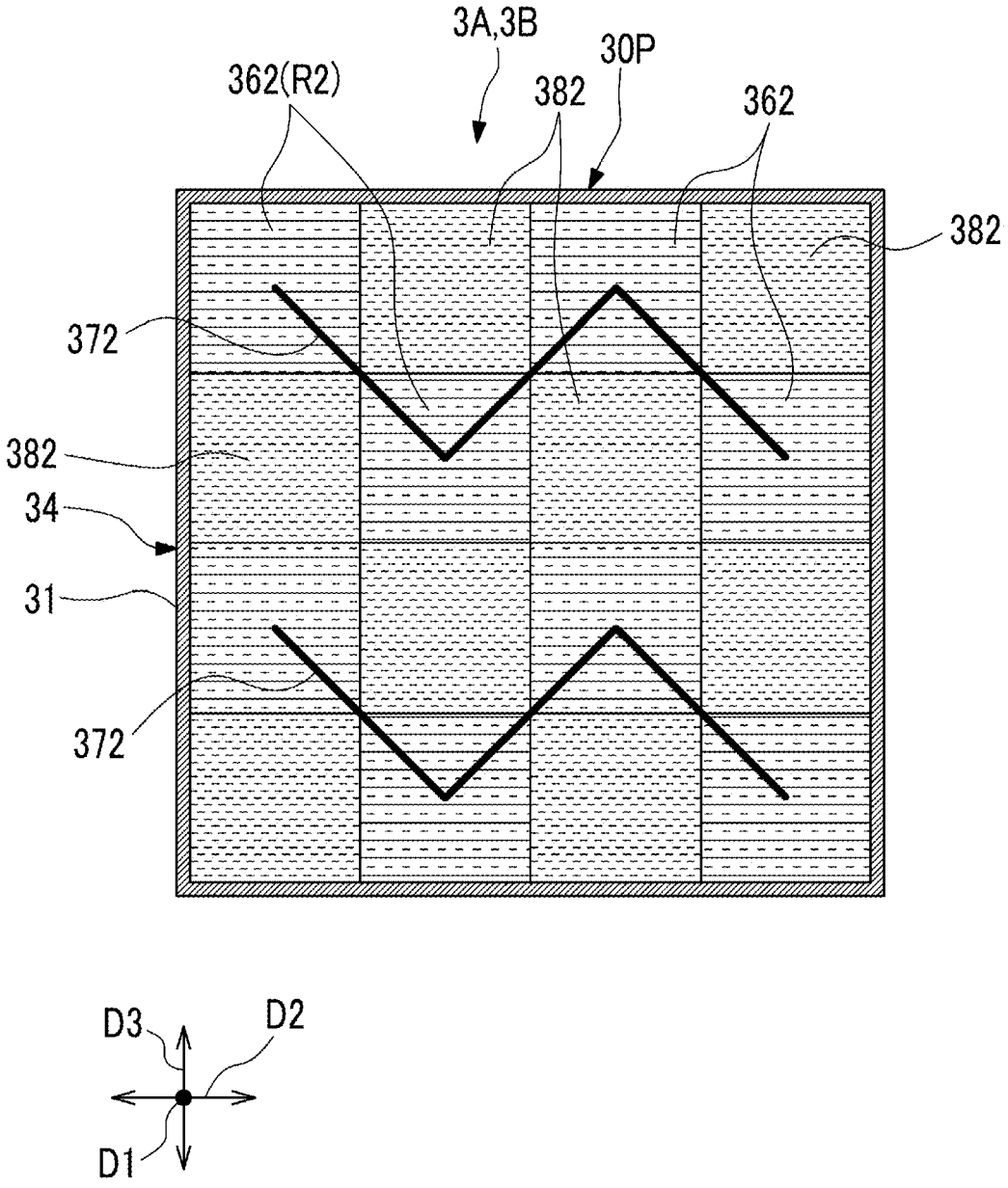
FIG. 5 is a diagram schematically showing a layout of a first flow channel connecting portion that connects the first flow channel of the second-stage flow channel section and a first flow channel of a third-stage flow channel section in the first flow channel portion of the above-described header member.

In addition, as shown in FIG. 3, in the second-stage flow channel section R2, which is adjacent to the first-stage flow channel section R1 on a side opposite to the heat exchanger 2 in the first direction D1, a secondary first flow channel 362 of the plurality of first flow channels 36 is disposed. As shown in FIG. 5, the secondary first flow channel 362 in the second-stage flow channel section R2 is disposed in a number that is, for example, one-fourth that of the primary first flow channels 361 (eight in the present embodiment) when viewed from the first direction D1. That is, the number of secondary first flow channels 362 is smaller than the number of primary first flow channels 361.

Figure 6:
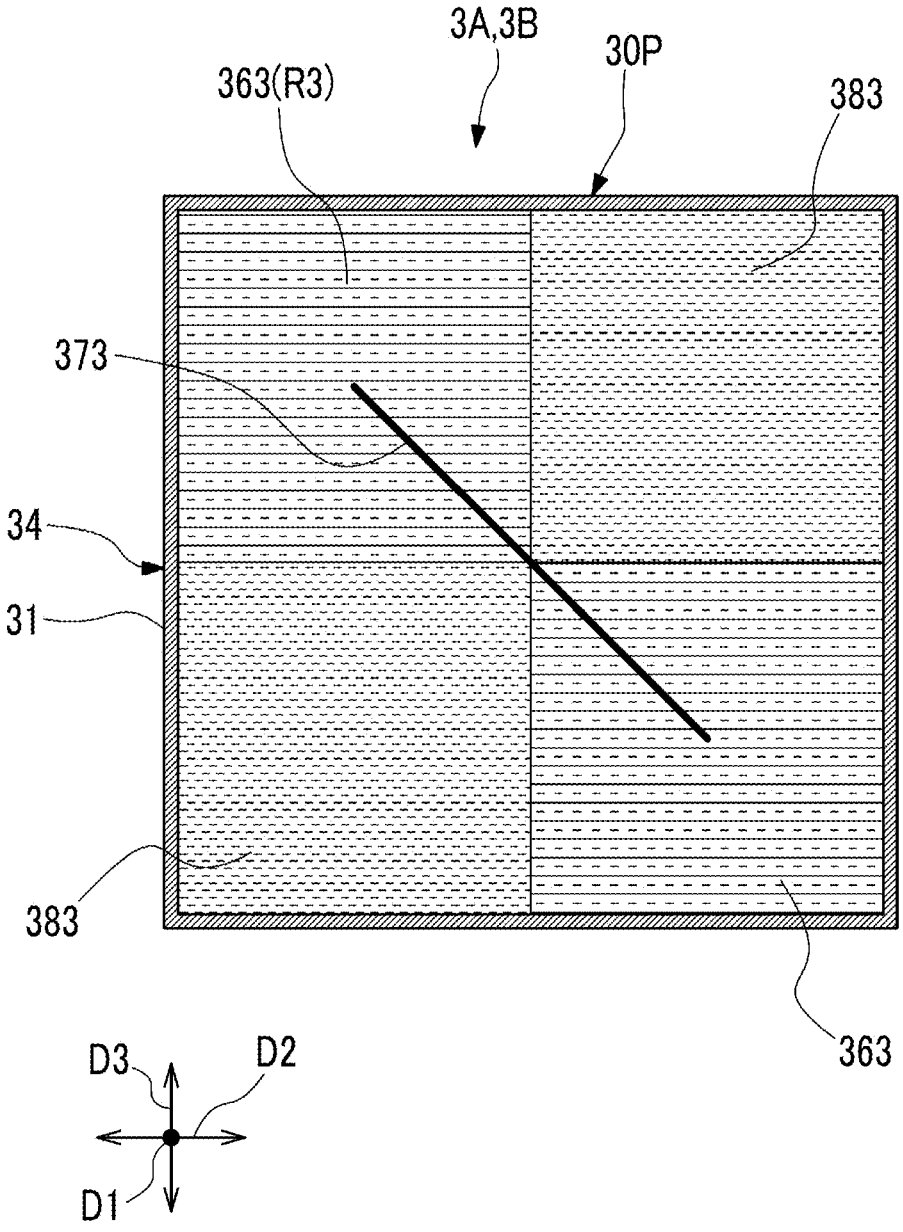
FIG. 6 is a diagram schematically showing a layout of a first flow channel connecting portion that connects the first flow channel of the third-stage flow channel section and a first flow channel of a fourth-stage flow channel section in the first flow channel portion of the above-described header member.

Additionally, as shown in FIG. 3, in the third-stage flow channel section R3, which is adjacent to the second-stage flow channel section R2 on the side opposite to the heat exchanger 2 in the first direction D1, a tertiary first flow channel 363 of the plurality of first flow channels 36 is disposed. As shown in FIG. 6, the tertiary first flow channel 363 in the third-stage flow channel section R3 is disposed in a number that is, for example, one-fourth that of the secondary first flow channels 362 (two in the present embodiment) when viewed from the first direction D1. That is, the number of tertiary first flow channels 363 is smaller than the number of secondary first flow channels 362.

Figure 7:
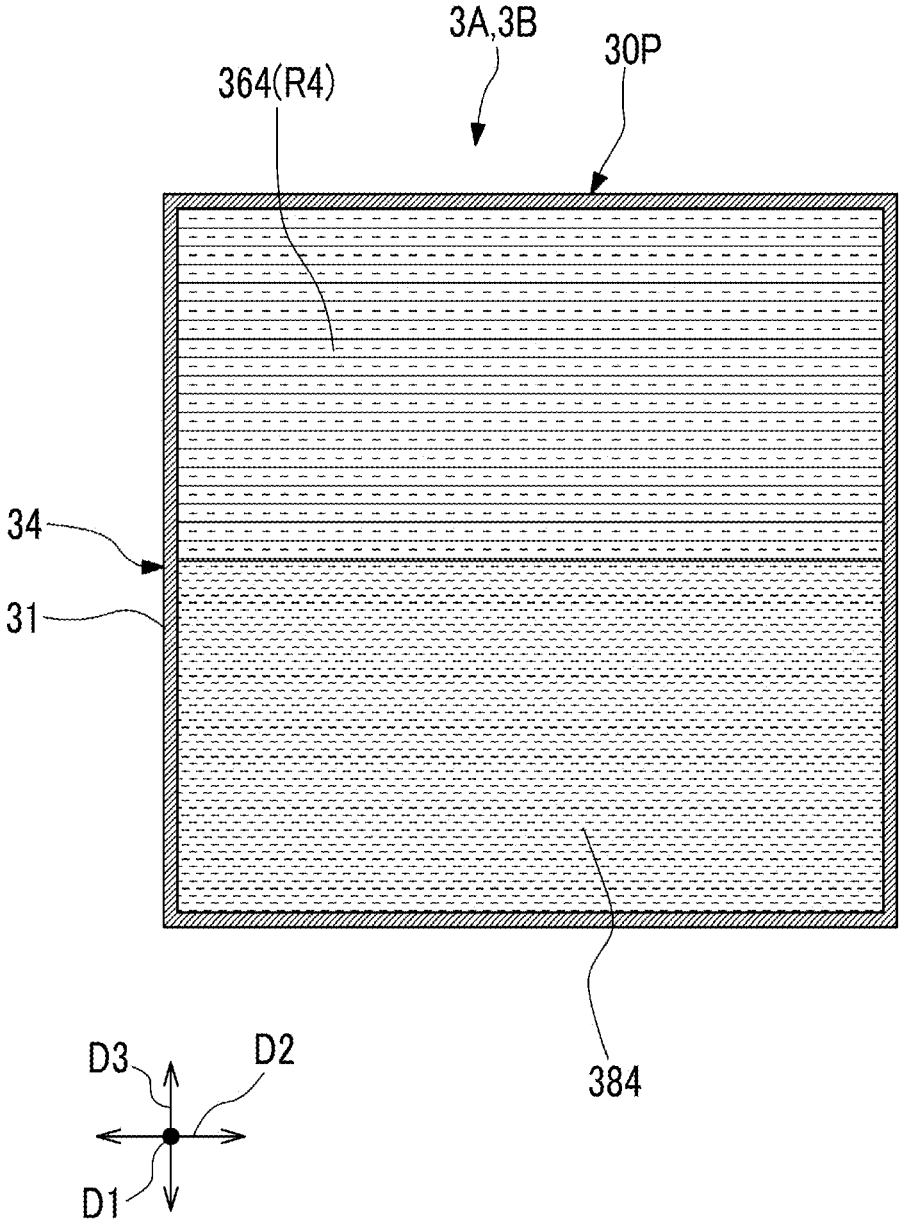
FIG. 7 is a diagram schematically showing a layout of the first flow channel and a second flow channel of the fourth-stage flow channel section in the first flow channel portion of the above-described header member.

Further, as shown in FIG. 3, in the fourth-stage flow channel section R4, which is adjacent to the third-stage flow channel section R3 on a side away from the heat exchanger 2 in the first direction D1, a quaternary first flow channel 364 of the plurality of first flow channels 36 is disposed. The fourth-stage flow channel section R4 is a flow channel section closest to the first external pipe connecting portion 32 in the present embodiment. The quaternary first flow channel 364 is connected directly to the first external pipe connecting portion 32. As shown in FIG. 7, the quaternary first flow channel 364 in the fourth-stage flow channel section R4 is disposed in a number that is, for example, half that of the tertiary first flow channels 363 (one in the present embodiment) when viewed from the first direction D1. That is, the number of quaternary first flow channels 364 is smaller than the number of tertiary first flow channels 363. Therefore, the quaternary first flow channel 364 has the smallest number among the plurality of first flow channels 36.

Furthermore, in the adjacent flow channel sections R1 to R4, it is preferable that the flow channel cross-sectional area of one first flow channel 36 that is close to the first external pipe connecting portion 32 is larger than the flow channel cross-sectional area (the cross-sectional area when viewed from the first direction D1) of one first flow channel 36 that is close to the heat exchanger 2 in the first direction D1. Therefore, the flow channel cross-section of one secondary first flow channel 362 of the second-stage flow channel section R2 is larger than the flow channel cross-sectional area of one of a plurality of primary first flow channels 361 of the first-stage flow channel section R1. The flow channel cross-section of one tertiary first flow channel 363 of the third-stage flow channel section R3 is larger than the flow channel cross-sectional area of one secondary first flow channel 362. The flow channel cross-sectional area of one quaternary first flow channel 364 of the fourth-stage flow channel section R3 is larger than the flow channel cross-sectional area of one tertiary first flow channel 363. Accordingly, in the present embodiment, among the plurality of first flow channels 36, the quaternary first flow channel 364 has the largest flow channel cross-sectional area, and the primary first flow channel 361 has the smallest flow channel cross-sectional area.

As shown in FIG. 3, the first flow channel connecting portion 37 is disposed between the adjacent flow channel sections R1 to R4, with at least one being provided for each. The first flow channel connecting portion 37 connects the plurality of first flow channels 36 adjacent to each other in the first direction D1. One first flow channel connecting portion 37 connects a plurality of (a large number of) first flow channels 36, which are close to the heat exchanger 2, and one first flow channel 36, which is close to the first external pipe connecting portion 32, with these flow channels being adjacent to each other in the first direction D1. The first flow channel connecting portion 37 connects at least two first flow channels 36 disposed at positions closest to each other when viewed from the first direction D1 in the adjacent flow channel sections.

Specifically, as shown in FIGS. 3 and 4, a primary first flow channel connecting portion 371 is disposed between the first-stage flow channel section R1 and the second-stage flow channel section R2 adjacent to each other in the first direction D1. The primary first flow channel connecting portion 371 connects a plurality of (in the present embodiment, four) primary first flow channels 361 of the first-stage flow channel section R1 and one secondary first flow channel 362 of the second-stage flow channel section R2. The primary first flow channel connecting portion 371 extends along a virtual plane that spreads in the second direction D2 and the third direction D3 inside the laminate 311*a*. In the present embodiment, one primary first flow channel connecting portion 371 is connected to a total of four primary first flow channels 361 that are adjacent to each other in an oblique direction intersecting the second direction D2 and the third direction D3, including the primary first flow channels 361 disposed at positions closest to each other when viewed from the first direction D1, in the first-stage flow channel section R1.

As shown in FIGS. 3 and 5, a secondary first flow channel connecting portion 372 is disposed between the second-stage flow channel section R2 and the third-stage flow channel section R3 adjacent to each other in the first direction D1. The secondary first flow channel connecting portion 372 connects a plurality of (in the present embodiment, four) secondary first flow channels 362 of the second-stage flow channel section R2 and one tertiary first flow channel 363 of the third-stage flow channel section R3. The secondary first flow channel connecting portion 372 extends along a virtual plane that spreads in the second direction D2 and the third direction D3 inside the laminate 311*b*. In the present embodiment, one secondary first flow channel connecting portion 372 is connected to a total of four secondary first flow channels 362 that are adjacent to each other in the oblique direction intersecting the second direction D2 and the third direction D3, including the secondary first flow channels 362 disposed at positions closest to each other when viewed from the first direction D1, in the second-stage flow channel section R2.

As shown in FIGS. 3 and 6, a tertiary first flow channel connecting portion 373 is disposed between the third-stage flow channel section R3 and the fourth-stage flow channel section R4 adjacent to each other in the first direction D1. The tertiary first flow channel connecting portion 373 connects a plurality of (in the present embodiment, two) tertiary first flow channels 363 of the third-stage flow channel section R3 and one quaternary first flow channel 364 of the fourth-stage flow channel section R4. The tertiary first flow channel connecting portion 373 extends along a virtual plane that spreads in the second direction D2 and the third direction D3 inside the laminate 311*c*. In the present embodiment, the tertiary first flow channel connecting portion 373 is connected to a plurality of tertiary first flow channels 363 disposed at positions closest to each other when viewed from the first direction D1 in the third-stage flow channel section R3. The tertiary first flow channel connecting portion 373 is connected to two tertiary first flow channels 363 adjacent to each other in the oblique direction intersecting the second direction D2 and the third direction D3 when viewed from the first direction D1.

The number and the disposition of the plurality of first flow channels 36 connected by the first flow channel connecting portion 37 can be appropriately changed, but it is preferable that the flow channel length of the first flow channel connecting portion 37 is as short as possible.

The first flow channel portion 34 configured in this manner branches or converges the flow of the first fluid F1 with respect to the heat exchanger 2. Specifically, in the first header 3A disposed on the inflow side of the first fluid F1 into the heat exchanger 2, the first fluid F1 flows into the first flow channel portion 34 through the first external pipe connecting portion 32 from the first external pipe 8A. In the first flow channel portion 34, the first fluid F1 flows from the quaternary first flow channel 364 of the fourth-stage flow channel section R4 into the tertiary first flow channel connecting portion 373. The first fluid F1 that has flowed into the tertiary first flow channel connecting portion 373 branches and flows into the plurality of tertiary first flow channels 363 of the third-stage flow channel section R3. After that, the first fluid F1 flows from each of the tertiary first flow channels 363 into the secondary first flow channel connecting portion 372. The first fluid F1 that has flowed into the secondary first flow channel connecting portion 372 branches and flows into the plurality of secondary first flow channels 362 of the second-stage flow channel section R2. After that, the first fluid F1 flows from each of the secondary first flow channels 362 into the primary first flow channel connecting portion 371. The first fluid F1 that has flowed into the primary first flow channel connecting portion 371 branches and flows into the plurality of primary first flow channels 361 of the first-stage flow channel section R1. As a result, the first fluid F1 flows into each of the plurality of first heat transfer pipes 21 through the primary first flow channel 361.

Additionally, in the second header 3B disposed on the outflow side of the first fluid F1 from the heat exchanger 2, the first fluid F1 flows into the first flow channel portion 34 from the plurality of first heat transfer pipes 21. In the first flow channel portion 34, the first fluid F1 flows from each of the plurality of first heat transfer pipes 21 into each of the plurality of primary first flow channels 361 of the first-stage flow channel section R1. The first fluid F1 that has flowed into the plurality of primary first flow channels 361 merges and flows into the primary first flow channel connecting portion 371. The first fluid F1 that has flowed into the primary first flow channel connecting portion 371 flows into one secondary first flow channel 362 of the second-stage flow channel section R2. The first fluid F1 that has flowed into the secondary first flow channel 362 merges and flows into the secondary first flow channel connecting portion 372. The first fluid F1 that has flowed into the secondary first flow channel connecting portion 372 flows into one tertiary first flow channel 363 of the third-stage flow channel section R3. The first fluid F1 that has flowed into the tertiary first flow channel 363 merges and flows into the tertiary first flow channel connecting portion 373. The first fluid F1 that has flowed into the tertiary first flow channel connecting portion 373 flows into the quaternary first flow channel 364 of the fourth-stage flow channel section R4. As a result, the first fluid F1 reaches one first external pipe connecting portion 32 through the quaternary first flow channel 364 and flows into the first external pipe 8B.

Figure 8:
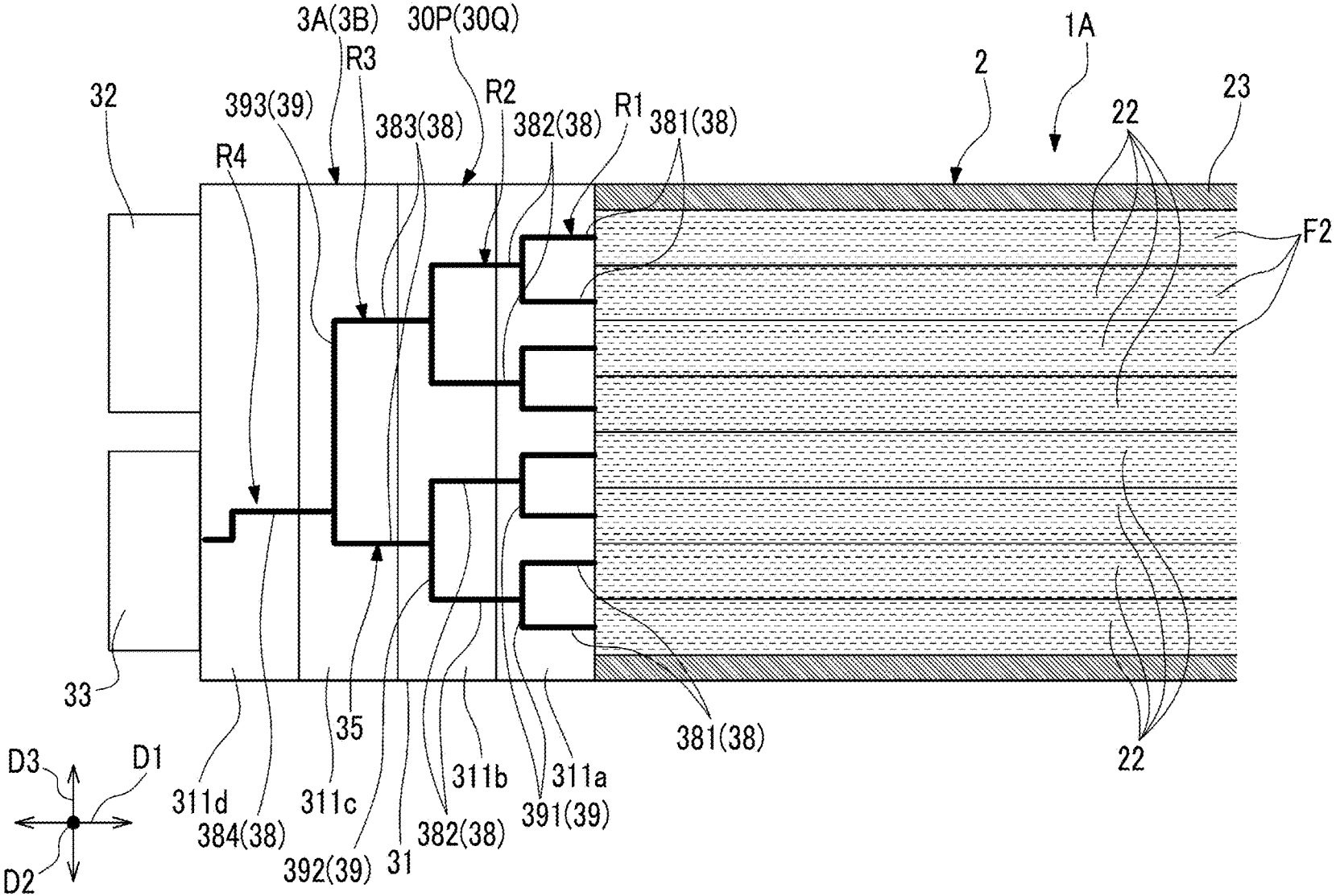
FIG. 8 is a diagram schematically showing a layout of second flow channels of a second flow channel portion in the above-described header member.

As shown in FIG. 8, the second flow channel portion 35 is disposed between open end portions of the plurality of second heat transfer pipes 22 and the second external pipe connecting portion 33. The second flow channel portion 35 includes a plurality of second flow channels 38 and a plurality of second flow channel connecting portions 39.

The plurality of second flow channels 38 are formed in the header body 31. More specifically, the plurality of second flow channels 38 of the present embodiment are formed by holes penetrating through the insides of the laminates 311*a* to 311*d*, together with the first flow channels 36. The plurality of second flow channels 38 are formed independently of the plurality of first flow channels 36 and the first flow channel connecting portion 37. The plurality of second flow channels 38 are connected to the end portions of all the second heat transfer pipes 22 at positions close to the heat exchanger 2 in the first direction D1. The plurality of second flow channels 38 are sequentially connected in a stepwise manner and are connected to the one second external pipe connecting portion 33. That is, the plurality of second flow channels 38 are connected to the second external pipe connecting portion 33 at positions farthest from the heat exchanger 2 in the first direction D1.

The second flow channel portion 35 includes a plurality of flow channel sections R1 to R4 in the same manner as the first flow channel portion 34. In the present embodiment, the flow channel sections R1 to R4 of the second flow channel portion 35 and the flow channel sections R1 to R4 of the first flow channel portion 34 are the same. The plurality of second flow channels 38 are formed across the plurality of flow channel sections R1 to R4 in the first direction D1. In the plurality of flow channel sections R1 to R4 of the second flow channel portion 35, the number of second flow channels 38 arranged in the second direction D2 decreases as a distance from the heat exchanger 2 increases in the first direction D1. In the present embodiment, in the plurality of flow channel sections R1 to R4 of the second flow channel 38, the number of first flow channels 36 arranged along a virtual plane, which spreads in the second direction D2 and the third direction when viewed from the first direction D1, decreases as the flow channel sections are farther from the heat exchanger 2. The second flow channels 38 of the present embodiment have the same configuration as the plurality of first flow channels 36.

Figure 9:
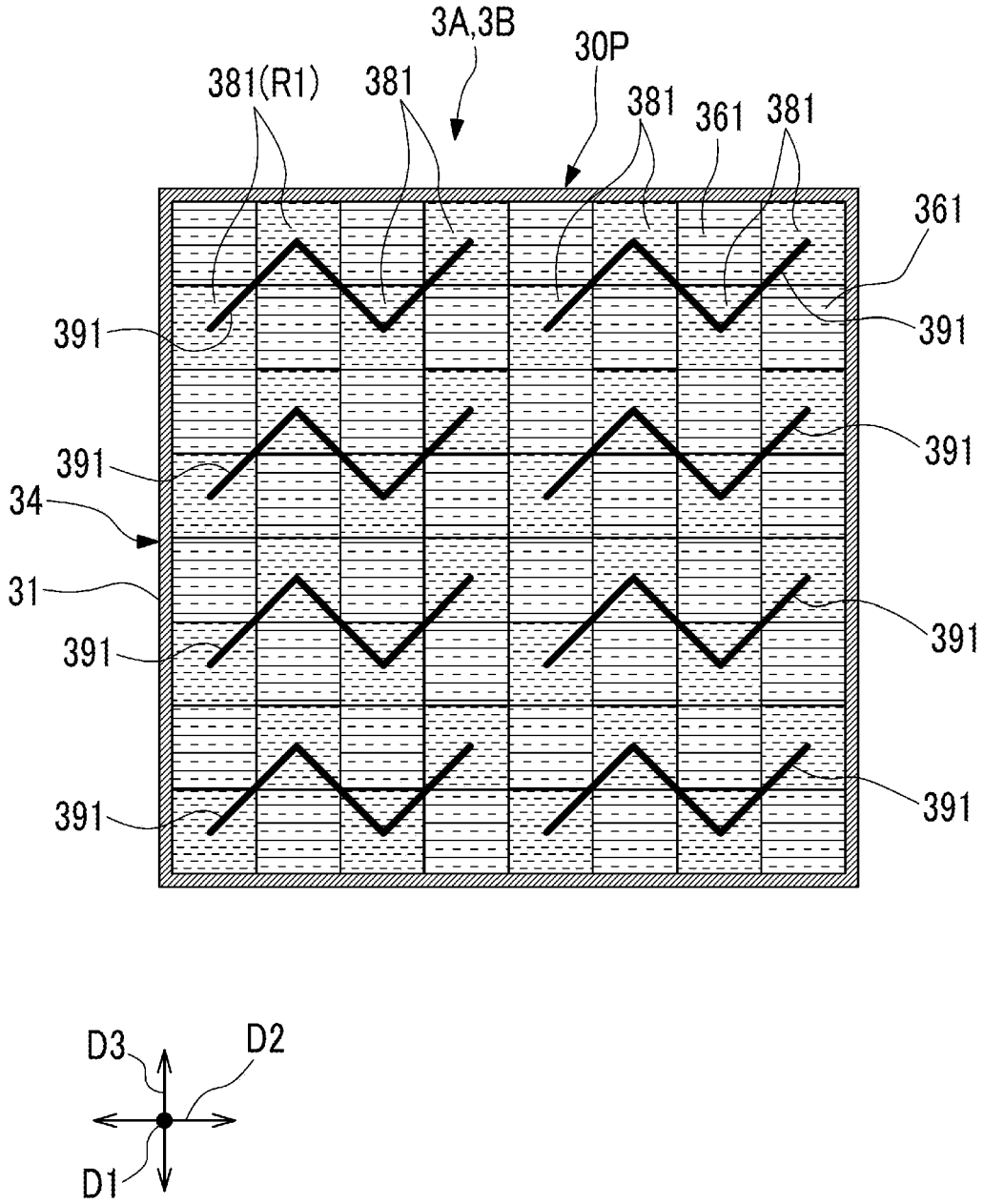
FIG. 9 is a diagram schematically showing a layout of a second flow channel connecting portion that connects a second flow channel of a first-stage flow channel section and a second flow channel of a second-stage flow channel section in the second flow channel portion of the above-described header member.

Specifically, among the plurality of flow channel sections R1 to R4, in the first-stage flow channel section R1, which is closest to the end portion of the heat exchanger 2, a primary second flow channel 381 of the second flow channels 38 is disposed. One primary second flow channel 381 is connected directly to one second heat transfer pipe 22. Therefore, as shown in FIG. 9, the primary second flow channel 381 in the first-stage flow channel section R1 is disposed in the same number as the second heat transfer pipes 22 when viewed from the first direction D1. That is, the primary second flow channel 381 has the largest number among the plurality of second flow channels 38.

Figure 10:
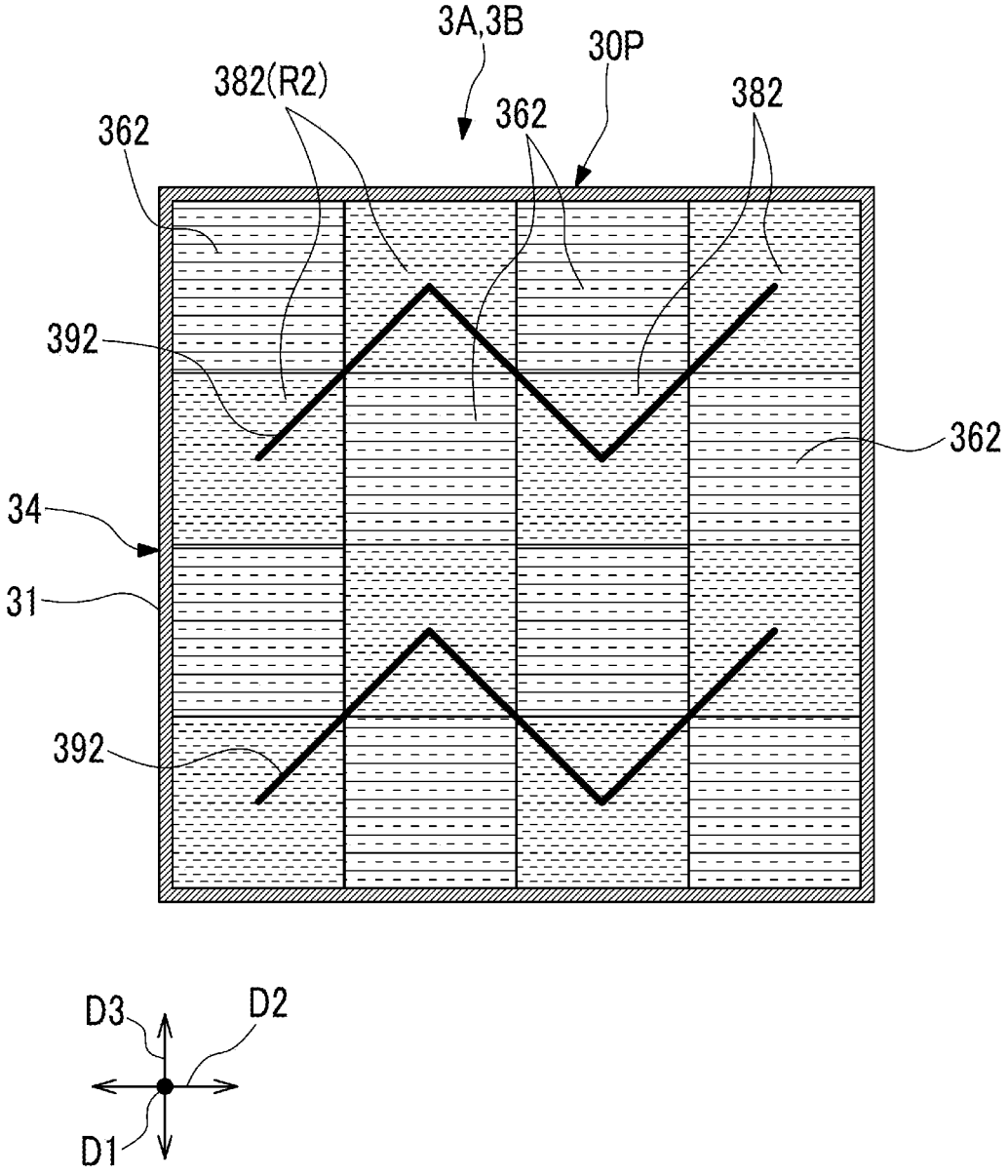
FIG. 10 is a diagram schematically showing a layout of a second flow channel connecting portion that connects the second flow channel of the second-stage flow channel section and a second flow channel of a third-stage flow channel section in the second flow channel portion of the above-described header member.

In addition, as shown in FIG. 8, in the second-stage flow channel section R2, which is adjacent to the first-stage flow channel section R1 on a side opposite to the heat exchanger 2 in the first direction D1, a secondary second flow channel 382 of the plurality of second flow channels 38 is disposed. As shown in FIG. 10, the secondary second flow channel 382 in the second-stage flow channel section R2 is disposed in a number that is, for example, one-fourth that of the primary second flow channels 381 (eight in the present embodiment) when viewed from the first direction D1. That is, the number of secondary second flow channels 382 is smaller than the number of primary second flow channels 381.

Figure 11:
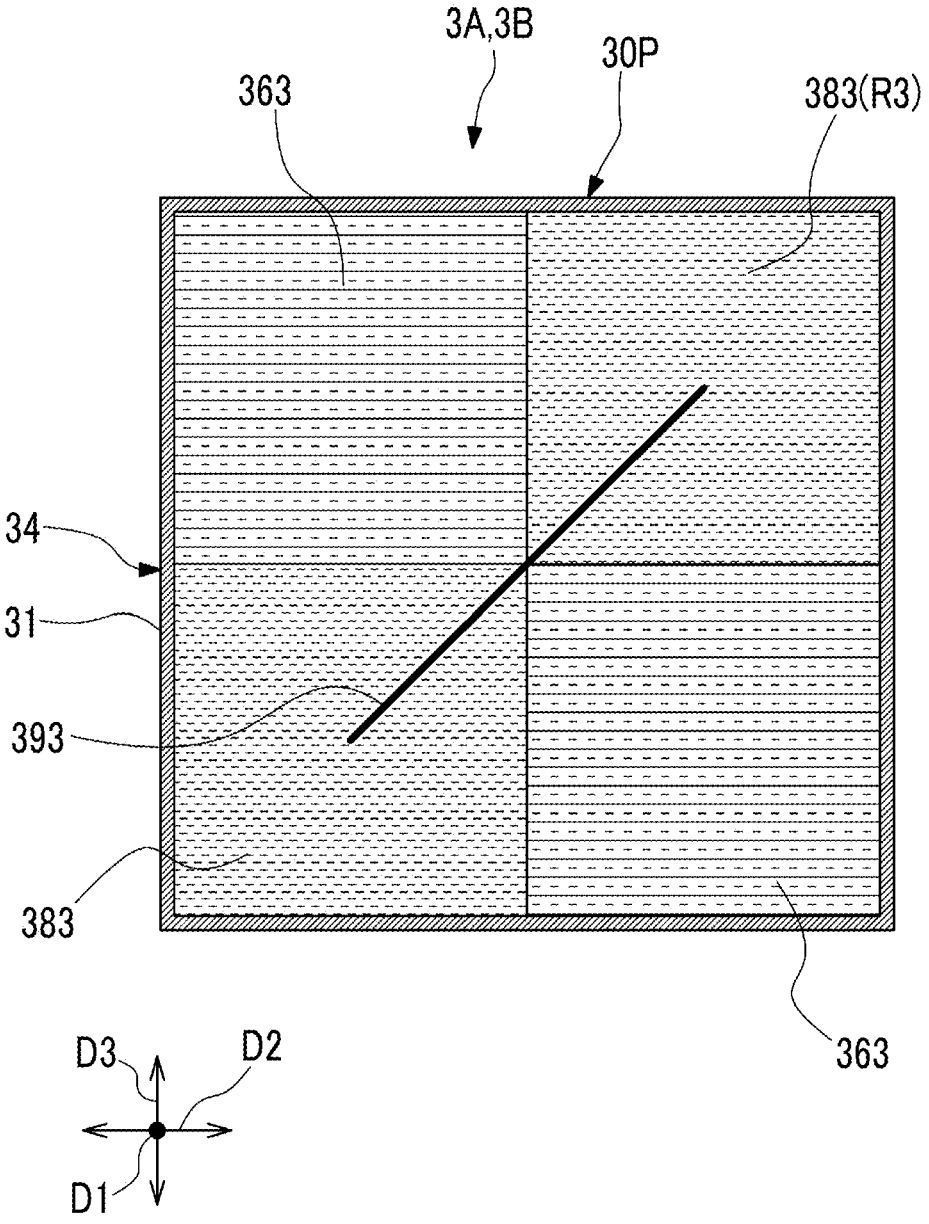
FIG. 11 is a diagram schematically showing a layout of a second flow channel connecting portion that connects the second flow channel of the third-stage flow channel section and a second flow channel of a fourth-stage flow channel section in the second flow channel portion of the above-described header member.

Additionally, as shown in FIG. 8, in the third-stage flow channel section R3, which is adjacent to the second-stage flow channel section R2 on the side opposite to the heat exchanger 2 in the first direction D1, a tertiary second flow channel 383 of the plurality of second flow channels 38 is disposed. As shown in FIG. 11, the tertiary second flow channel 383 in the third-stage flow channel section R3 is disposed in a number that is, for example, one-fourth that of the secondary second flow channels 382 (two in the present embodiment) when viewed from the first direction DL. That is, the number of tertiary second flow channels 383 is smaller than the number of secondary second flow channels 382.

Further, as shown in FIG. 8, in the fourth-stage flow channel section R4, which is adjacent to the third-stage flow channel section R3 on a side away from the heat exchanger 2 in the first direction D1, a quaternary second flow channel 384 of the plurality of second flow channels 38 is disposed. The fourth-stage flow channel section R4 is a flow channel section closest to the second external pipe connecting portion 33 in the present embodiment. The quaternary second flow channel 384 is connected directly to the second external pipe connecting portion 33. As shown in FIG. 7, the quaternary second flow channel 384 in the fourth-stage flow channel section R4 is disposed in a number that is, for example, half that of the tertiary second flow channels 383 (one in the present embodiment) when viewed from the first direction D1. That is, the number of quaternary second flow channels 384 is smaller than the number of tertiary second flow channels 383. Therefore, the quaternary second flow channel 384 has the smallest number among the plurality of second flow channels 38.

Furthermore, in the adjacent flow channel sections R1 to R4, it is preferable that the flow channel cross-sectional area of one second flow channel 38 that is close to the second external pipe connecting portion 33 is larger than the flow channel cross-sectional area (the cross-sectional area when viewed from the first direction D1) of one second flow channel 38 that is close to the heat exchanger 2 in the first direction D1. Therefore, the flow channel cross-section of one secondary second flow channel 382 of the second-stage flow channel section R2 is larger than the flow channel cross-sectional area of one of a plurality of primary second flow channels 381 of the first-stage flow channel section R1. The flow channel cross-section of one secondary second flow channel 382 of the third-stage flow channel section R3 is larger than the flow channel cross-sectional area of one secondary second flow channel 382. The flow channel cross-sectional area of one quaternary second flow channel 384 of the fourth-stage flow channel section R3 is larger than the flow channel cross-sectional area of one tertiary second flow channel 383. Accordingly, in the present embodiment, among the plurality of second flow channels 38, the quaternary second flow channel 384 has the largest flow channel cross-sectional area, and the primary second flow channel 381 has the smallest flow channel cross-sectional area.

As shown in FIG. 8, the second flow channel connecting portion 39 is disposed between the adjacent flow channel sections R1 to R4, with at least one being provided for each. The second flow channel connecting portion 39 connects the plurality of second flow channels 38 adjacent to each other in the first direction D1. One second flow channel connecting portion 39 connects a plurality of (a large number of) second flow channels 38, which are close to the heat exchanger 2, and one second flow channel 38, which is close to the second external pipe connecting portion 33, with the flow channels being adjacent to each other in the first direction D1. The second flow channel connecting portion 39 connects at least two second flow channels 38 disposed at positions closest to each other when viewed from the first direction D1 in the adjacent flow channel sections. In addition, the second flow channel connecting portion 39 is formed in an independent state not to interfere with the first flow channel connecting portion 37 or the first flow channel 36.

Specifically, as shown in FIGS. 8 and 9, a primary second flow channel connecting portion 391 is disposed between the first-stage flow channel section R1 and the second-stage flow channel section R2 adjacent to each other in the first direction D1. The primary second flow channel connecting portion 391 connects a plurality of (in the present embodiment, four) primary second flow channels 381 of the first-stage flow channel section R1 and one secondary second flow channel 382 of the second-stage flow channel section R2. The primary second flow channel connecting portion 391 extends along a virtual plane that spreads in the second direction D2 and the third direction D3 inside the laminate 311*a*. In the present embodiment, one primary second flow channel connecting portion 391 is connected to a total of four primary second flow channels 381 that are adjacent to each other in the oblique direction intersecting the second direction D2 and the third direction D3, including the primary second flow channels 381 disposed at positions closest to each other when viewed from the first direction D1, in the first-stage flow channel section R1.

As shown in FIGS. 8 and 10, a secondary second flow channel connecting portion 392 is disposed between the second-stage flow channel section R2 and the third-stage flow channel section R3 adjacent to each other in the first direction D1. The secondary second flow channel connecting portion 392 connects a plurality of (in the present embodiment, four) secondary second flow channels 382 of the second-stage flow channel section R2 and one tertiary second flow channel 383 of the third-stage flow channel section R3. The secondary second flow channel connecting portion 392 extends along a virtual plane that spreads in the second direction D2 and the third direction D3 inside the laminate 311*b*. In the present embodiment, one secondary second flow channel connecting portion 392 is connected to a total of four secondary second flow channels 382 that are adjacent to each other in the oblique direction intersecting the second direction D2 and the third direction D3, including the secondary second flow channels 382 disposed at positions closest to each other when viewed from the first direction D1, in the second-stage flow channel section R2.

As shown in FIGS. 8 and 11, a tertiary second flow channel connecting portion 393 is disposed between the third-stage flow channel section R3 and the fourth-stage flow channel section R4 adjacent to each other in the first direction D1. The tertiary second flow channel connecting portion 393 connects a plurality of (in the present embodiment, two) tertiary second flow channels 383 of the third-stage flow channel section R3 and one quaternary second flow channel 384 of the fourth-stage flow channel section R4. The tertiary second flow channel connecting portion 393 extends along a virtual plane that spreads in the second direction D2 and the third direction D3 inside the laminate 311*c*. In the present embodiment, the tertiary second flow channel connecting portion 393 is connected to a plurality of tertiary second flow channels 383 disposed at positions closest to each other when viewed from the first direction D1 in the third-stage flow channel section R3. The tertiary second flow channel connecting portion 393 is connected to two tertiary second flow channels 383 adjacent to each other in the oblique direction intersecting the second direction D2 and the third direction D3 when viewed from the first direction D1.

The number and the disposition of the plurality of second flow channels 38 connected by the second flow channel connecting portion 39 can be appropriately changed, but it is preferable that the flow channel length of the second flow channel connecting portion 39 is as short as possible.

In order to avoid the intersection with the first flow channel connecting portion 37, the second flow channel connecting portion 39 is disposed inside the laminates 311*a* to 311*d* to be shifted from the first flow channel connecting portion 37 in the first direction D1.

The second flow channel portion 35 configured in this manner branches or converges the flow of the second fluid F2 with respect to the heat exchanger 2. Specifically, in the second header 3B disposed on the inflow side of the second fluid F2 into the heat exchanger 2, the second fluid F2 flows into the second flow channel portion 35 through the second external pipe connecting portion 33 from the second external pipe 9B. In the second flow channel portion 35, the second fluid F2 flows from the quaternary second flow channel 384 of the fourth-stage flow channel section R4 to the tertiary second flow channel connecting portion 393. The second fluid F2 that has flowed into the tertiary second flow channel connecting portion 393 branches and flows into the plurality of tertiary second flow channels 383 of the third-stage flow channel section R3. After that, the second fluid F2 flows from each of the tertiary second flow channels 383 into the secondary second flow channel connecting portion 392. The second fluid F2 that has flowed into the secondary second flow channel connecting portion 392 branches and flows into the plurality of secondary second flow channels 382 of the second-stage flow channel section R2. After that, the second fluid F2 flows from each of the secondary second flow channels 382 into the primary second flow channel connecting portion 391. The second fluid F2 that has flowed into the primary second flow channel connecting portion 391 branches and flows into the plurality of primary second flow channels 381 of the first-stage flow channel section R1. As a result, the second fluid F2 flows into each of the plurality of second heat transfer pipes 22 through the primary second flow channel 381.

Additionally, in the first header 3A disposed on the outflow side of the second fluid F2 from the heat exchanger 2, the second fluid F2 flows into the second flow channel portion 35 from the plurality of second heat transfer pipes 22. In the second flow channel portion 35, the second fluid F2 flows from each of the plurality of second heat transfer pipes 22 into each of the plurality of primary second flow channels 381 of the first-stage flow channel section R1. The second fluid F2 that has flowed into the plurality of primary second flow channels 381 merges and flows into the primary second flow channel connecting portion 391. The second fluid F2 that has flowed into the primary second flow channel connecting portion 391 flows into one secondary second flow channel 382 of the second-stage flow channel section R2. The second fluid F2 that has flowed into the secondary second flow channel 382 merges and flows into the secondary second flow channel connecting portion 392. The second fluid F2 that has flowed into the secondary second flow channel connecting portion 392 flows into one tertiary second flow channel 383 of the third-stage flow channel section R3. The second fluid F2 that has flowed into the tertiary second flow channel 383 merges and flows into the tertiary second flow channel connecting portion 393. The second fluid F2 that has flowed into the tertiary second flow channel connecting portion 393 flows into the quaternary second flow channel 384 of the fourth-stage flow channel section R4. As a result, the second fluid F2 reaches one second external pipe connecting portion 33 through the quaternary second flow channel 384 and flows into the second external pipe 9A.

(Procedure of Method for Manufacturing Header Member)

Figure 12:
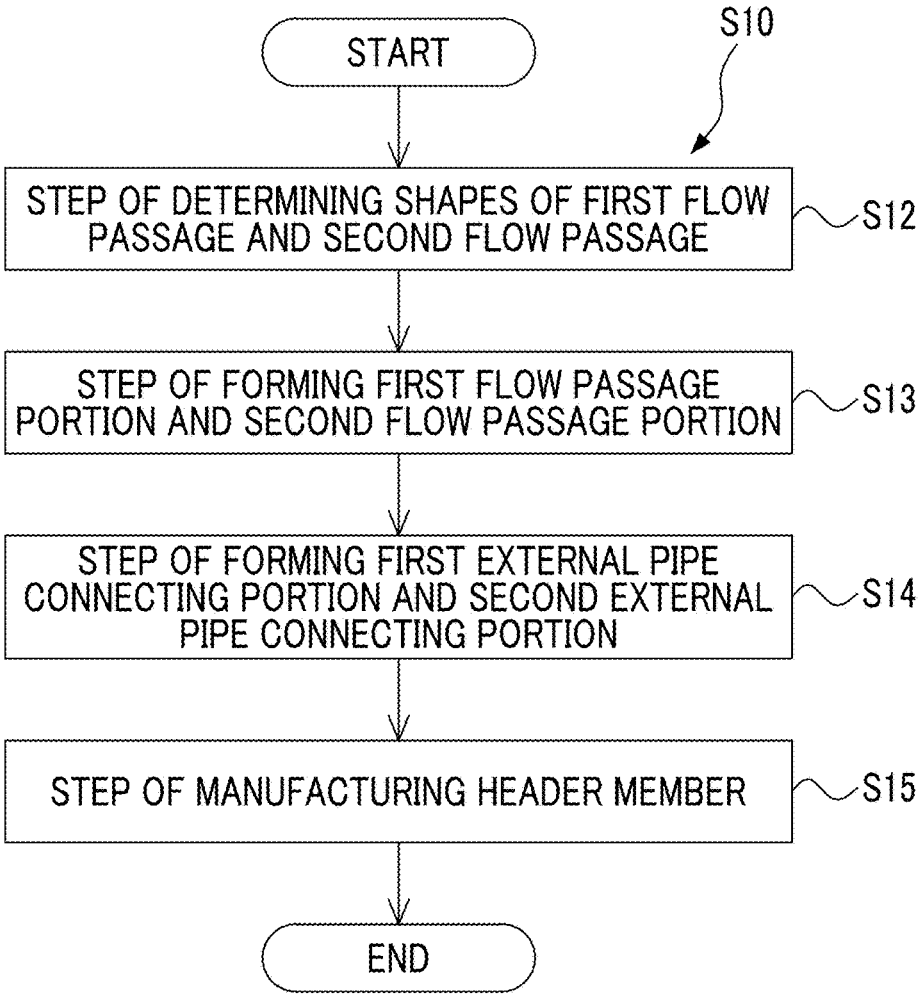
FIG. 12 is a flowchart showing a procedure of a method for manufacturing a header member according to a first embodiment of the present disclosure.

Next, a method for manufacturing the header member 30P as described above will be described. As shown in FIG. 12, a method S10 for manufacturing the header member 30P according to the embodiment of the present disclosure includes a step S12 of determining the shapes of the first flow channel 36 and the second flow channel 38, a step S13 of forming the first flow channel portion 34 and the second flow channel portion 35, a step S14 of forming the first external pipe connecting portion 32 and the second external pipe connecting portion 33, and a step S15 of manufacturing the header member 30P.

In the step S12 of determining the shapes of the first flow channel 36 and the second flow channel 38, the shapes of the first flow channel 36 and the second flow channel 38 are determined. Specifically, for example, as described above, in the adjacent flow channel sections R1 to R4, the shapes are determined such that the flow channel cross-sectional areas of one first flow channel 36 and one second flow channel 38, which are close to the first external pipe connecting portion 32, are larger than the flow channel cross-sectional areas of the plurality of first flow channels 36 and second flow channels 38, which are close to the heat exchanger 2 in the first direction D1.

In the step S13 of forming the first flow channel portion 34 and the second flow channel portion 35, the first flow channel portion 34 and the second flow channel portion 35 are formed based on the shapes of the first flow channel 36 and the second flow channel 38 determined in the step S12. In the present embodiment, the plurality of first flow channels 36 (361 to 363) and second flow channels 38 (381 to 383) are formed in each of the laminates 311*a* to 311*d*. After that, the laminates 311*a* to 311*d* are stacked in the first direction D1, thereby forming the header body 31.

In the step S14 of forming the first external pipe connecting portion 32 and the second external pipe connecting portion 33, the first external pipe connecting portion 32 and the second external pipe connecting portion 33 are each formed in a predetermined shape.

In the step S15 of manufacturing the header member 30P, the first flow channel portion 34 and the second flow channel portion 35 formed in the step S13, and the first external pipe connecting portion 32 and the second external pipe connecting portion 33 formed in the step S14 are connected and fixed. As a result, the header member 30P configuring the first header 3A and the second header 3B is manufactured.

Actions and Effects

In the header member 30P having the above-described configuration, the first flow channel portion 34 includes the plurality of first flow channels 36 coupled respectively to the plurality of first heat transfer pipes 21. The second flow channel portion 35 includes the plurality of second flow channels 38 coupled respectively to the plurality of second heat transfer pipes 22. The plurality of first flow channels 36 are sequentially connected in a stepwise manner and are connected to the one first external pipe connecting portion 32. The plurality of second flow channels 38 are sequentially connected in a stepwise manner and are connected to the one second external pipe connecting portion 33. The plurality of second flow channels 38 are formed independently of the first flow channels 36. In this manner, the plurality of first flow channels 36 and the plurality of second flow channels 38 that are sequentially connected in a stepwise manner are connected to the one first external pipe connecting portion 32 and the one second external pipe connecting portion 33 without allowing the fluid flowing inside to mix. As a result, it is possible to branch or converge the first fluid F1 and the second fluid F2 with a simple configuration without mixing the first fluid F1 and the second fluid F2 with respect to the heat exchanger 2 having a configuration in which the plurality of first heat transfer pipes 21 and the plurality of second heat transfer pipes 22 are disposed to be adjacent to each other.

In addition, the first flow channel portion 34 and the second flow channel portion 35 are respectively connected by the first flow channel connecting portion 37 and the second flow channel connecting portion 39 disposed between the adjacent flow channel sections R1 to R4. Therefore, the number of the plurality of first flow channels 36 and the plurality of second flow channels 38 in each flow channel section gradually decreases as the distance from the heat exchanger 2 increases in the flow channel sections R1 to R3 close to the heat exchanger 2 and the flow channel sections R2 to R4 close to the first external pipe connecting portion 32 in the first direction D1. As a result, it is possible to branch or converge the first flow channel 36 and the second flow channel 38 with a simple configuration with respect to the heat exchanger 2.

Additionally, the first flow channel connecting portion 37 and the second flow channel connecting portion 39 respectively connect two or more first flow channels 36 and two or more second flow channels 38, which are disposed at positions closest to each other when viewed from the first direction D1, in the adjacent flow channel sections R1 to R4. Consequently, the flow channel lengths of the first flow channel connecting portion 37 and the second flow channel connecting portion 39 can be shortened. Therefore, the overall flow channel length in the first flow channel portion 34 and the second flow channel portion 35 can also be shortened. Accordingly, it is possible to suppress the pressure loss in the first flow channel portion 34 and the second flow channel portion 35.

Further, the first flow channel portion 34 and the second flow channel portion 35 are configured by the plurality of laminates 311*a* to 311*d*. As a result, by simply stacking the plurality of laminates 311*a* to 311*d*, it is possible to easily achieve a configuration in which the first flow channels 36 and the second flow channels 38 are sequentially connected by the first flow channel connecting portion 37 and the second flow channel connecting portion 39.

In addition, in the adjacent flow channel sections R1 to R4, the flow channel cross-sectional areas of one first flow channel 36 and one second flow channel 38, which are close to the first external pipe connecting portion 32, are set to be larger than the flow channel cross-sectional areas of the plurality of first flow channels 36 and second flow channels 38, which are close to the heat exchanger 2 in the first direction D1. Consequently, the pressure loss in a case where the plurality of first flow channels 36 and the plurality of second flow channels 38 merge with or branch from one first flow channel 36 and one second flow channel 38 is suppressed. Therefore, it is possible to suppress a decrease in the flow efficiency of the first fluid F1 and the second fluid F2 in the first flow channel portion 34 and the second flow channel portion 35.

The heat exchanger unit 1A having the above-described configuration includes the heat exchanger 2 and the header member 30P. As a result, it is possible to provide the heat exchanger unit 1A including the header member 30P that branches or converges the first fluid F1 and the second fluid F2 with a simple configuration without mixing the first fluid F1 and the second fluid F2 with respect to the heat exchanger 2 having a configuration in which the plurality of first heat transfer pipes 21 and the plurality of second heat transfer pipes 22 are disposed to be adjacent to each other.

In the method S10 for manufacturing the header member 30P having the above-described configuration, the header member 30P including the first flow channel 36 and the second flow channel 38 can be manufactured. Therefore, it is possible to provide the header member 30P that branches or converges the first fluid F1 and the second fluid F2 with a simple configuration without mixing the first fluid F1 and the second fluid F2 with respect to the heat exchanger 2 having a configuration in which the plurality of first heat transfer pipes 21 and the plurality of second heat transfer pipes 22 are disposed to be adjacent to each other.

Second Embodiment

Next, a second embodiment of the header member, the heat exchanger unit, and the method for manufacturing a header member according to the present disclosure will be described. In the second embodiment to be described below, the same reference numerals will be assigned to configurations that are common to those of the above-described first embodiment in the drawings, and description thereof will be omitted. The second embodiment is different from the first embodiment in that the first flow channel portion 34 and the second flow channel portion 35 of a header member 30Q include a first flow rate distribution adjustment portion 70A and a second flow rate distribution adjustment portion 70B.

Figure 13:
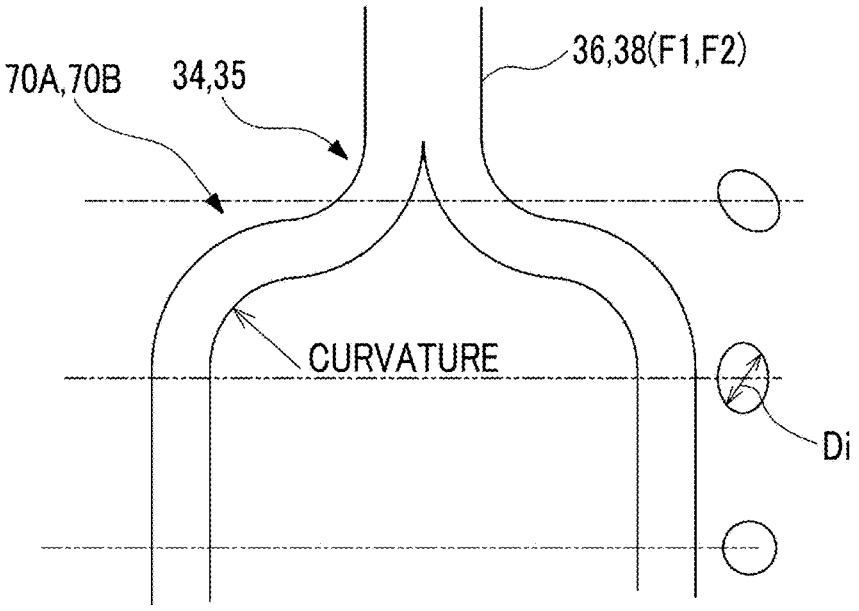
FIG. 13 is a diagram schematically showing a first flow rate distribution adjustment portion and a second flow rate distribution adjustment portion provided in a header member according to a second embodiment of the present disclosure.

In a heat exchanger unit 1B (refer to FIG. 1), the first header 3A and the second header 3B are each configured by the header member 30Q. The header member 30Q includes the first flow rate distribution adjustment portion 70A and the second flow rate distribution adjustment portion 70B as shown in FIG. 13, in addition to the header body 31, the first external pipe connecting portion 32, the second external pipe connecting portion 33, the first flow channel portion 34, and the second flow channel portion 35 as in the header member 30P of the above-described first embodiment.

The first flow rate distribution adjustment portion 70A is disposed in the first flow channel portion 34. The first flow rate distribution adjustment portion 70A adjusts a flow rate distribution of the first fluid F1 in the plurality of first flow channels 36. The first flow rate distribution adjustment portion 70A adjusts the flow rate distribution of the first fluid F1 in the plurality of first flow channels 36 such that the flow resistance of the first flow channels 36 in each of the flow channel sections R1 to R4 is constant. Specifically, the first flow rate distribution adjustment portion 70A adjusts the flow rate distribution of the first fluid F1 in the plurality of first flow channels 36 by changing at least one of a diameter, a curvature, and a flow channel surface roughness of the flow channel for at least one of the plurality of first flow channels 36. That is, the first flow rate distribution adjustment portion 70A is formed as a part of the plurality of first flow channels 36 or as the first flow channel 36 itself. For example, the first flow rate distribution adjustment portion 70A is formed by increasing the curvature of the first flow channel 36 as compared with the other first flow channels 36 of the same flow channel section, in the first flow channel 36 having the highest flow resistance among the plurality of first flow channels 36. In this case, the curvature of a part of the connecting portion between the first flow channel 36 and the first flow channel connecting portion 37 is adjusted to be different depending on the location where it is disposed. As a result, the flow resistance is reduced in a part of the plurality of first flow channels 36. In addition, the first flow rate distribution adjustment portion 70A is formed, for example, by increasing the flow channel surface roughness as compared with the other first flow channels 36 of the same flow channel section, in the first flow channel 36 having the highest flow rate (the lowest flow resistance) among the plurality of first flow channels 36. In this case, the surface roughness of a part of inner peripheral surfaces of the plurality of first flow channels 36 is adjusted to be different depending on the location where it is disposed. As a result, the flow resistance may be increased in a part of the plurality of first flow channels 36.

The second flow rate distribution adjustment portion 70B is disposed in the second flow channel portion 35. The second flow rate distribution adjustment portion 70B adjusts a flow rate distribution of the second fluid F2 in the plurality of second flow channels 38. In the second flow rate distribution adjustment portion 70B, the flow rate distribution of the second fluid F2 in the plurality of second flow channels 38 is adjusted such that the flow resistance of the second flow channel 38 in each of the flow channel sections R1 to R4 is constant, in the same manner as in the first flow rate distribution adjustment portion 70A. Specifically, the second flow rate distribution adjustment portion 70B adjusts the flow rate distribution of the second fluid F2 in the plurality of second flow channels 38 by changing at least one of a diameter, a curvature, and a flow channel surface roughness of the flow channel for at least one of the plurality of second flow channels 38. That is, the second flow rate distribution adjustment portion 70B is formed as a part of the second flow channels 38 or as the second flow channel 38 itself. For example, the second flow rate distribution adjustment portion 70B is formed by increasing the curvature of the second flow channel 38 as compared with the other second flow channels 38 of the same flow channel section, in the second flow channel 38 having the highest flow resistance among the plurality of second flow channels 38. As a result, the flow resistance is reduced in a part of the plurality of second flow channels 38. Additionally, the second flow rate distribution adjustment portion 70B is formed, for example, by increasing the flow channel surface roughness as compared with the other second flow channels 38 of the same flow channel section, in the second flow channel 38 having the highest flow rate (the lowest flow resistance) among the plurality of second flow channels 38. As a result, the flow resistance may be increased in a part of the plurality of second flow channels 38.

(Procedure of Method for Manufacturing Header Member)

Next, a method for manufacturing the header member 30Q as described above will be described.

Figure 14:
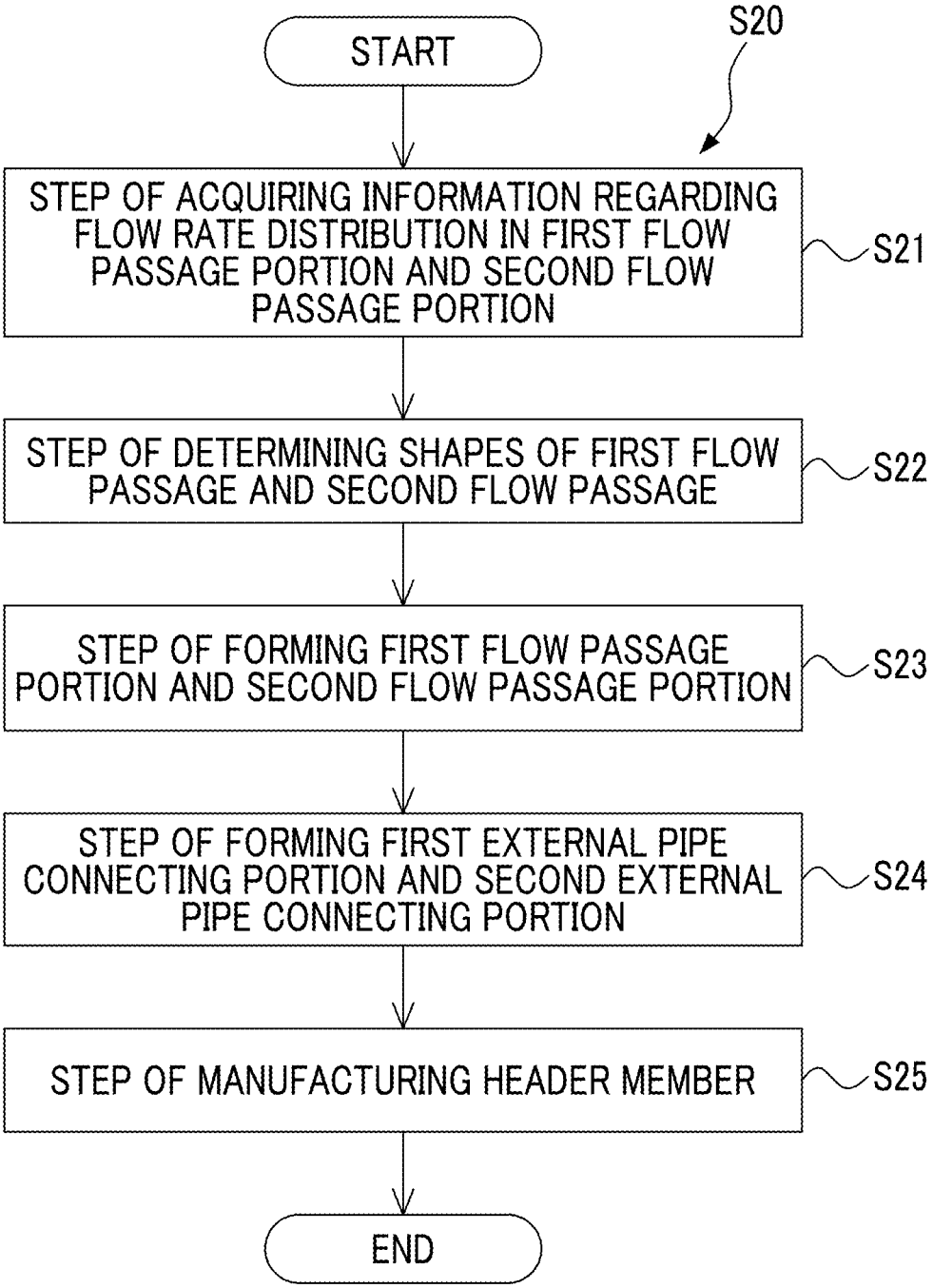
FIG. 14 is a flowchart showing a procedure of a method for manufacturing the header member according to the second embodiment of the present disclosure.

As shown in FIG. 14, a method S20 for manufacturing the header member 30Q according to the embodiment of the present disclosure includes a step S21 of acquiring information regarding the flow rate distribution in the first flow channel portion 34 and the second flow channel portion 35, a step S22 of determining the shapes of the first flow channel 36 and the second flow channel 38, a step S23 of forming the first flow channel portion 34 and the second flow channel portion 35, a step S24 of forming the first external pipe connecting portion 32 and the second external pipe connecting portion 33, and a step S25 of manufacturing the header member 30Q.

In the step S21 of acquiring the information regarding the flow rate distribution in the first flow channel portion 34 and the second flow channel portion 35, the information regarding the flow rate distribution of the first fluid F1 among the plurality of first flow channels 36 in the first flow channel portion 34 is acquired as the information regarding the flow rate distribution in the first flow channel portion 34. In addition, the information regarding the flow rate distribution of the second fluid F2 among the plurality of second flow channels 38 in the second flow channel portion 35 is acquired as the information regarding the flow rate distribution in the second flow channel portion 35.

Specifically, an example of a case of acquiring the information regarding the flow rate distribution for the first flow channel 36 will be described. In a case where the first flow channel 36 is divided into infinitesimal segments in the first direction D1, a pressure loss dPi of the first flow channel 36 in each infinitesimal segment is represented by Equation (1).

$$dP_i = \xi_i \frac{x_i}{D_i} \frac{G^2}{2\rho A_i^2} \tag{1}$$

Here, $\xi i$ is a resistance coefficient of the flow channel, $\chi i$ is a length of the infinitesimal segment, Di is an equivalent diameter of the flow channel, G is a mass flow rate of the fluid, $\rho$ is a density of the fluid, A is a flow channel cross-sectional area, and the subscript i is an infinitesimal segment number.

Based on Equation (1), the total loss dP of the entire flow channel of each first flow channel 36 is represented by Equation (2).

$$dP = \sum_i^N dP_i = \sum_i^N \xi_i \frac{x_i}{D_i} \frac{G^2}{2\rho A_i^2} \tag{2}$$

The condition under which the flow resistance of the first flow channel 36 in each of the flow channel sections R1 to R4 is constant is adjusted based on the total loss dP of the pressure for the plurality of first flow channels 36 calculated using Equation (2). As a result, the flow rate distribution of the first fluid F1 in the plurality of first flow channels 36 is adjusted.

In this manner, the pressure losses in the plurality of first flow channels 36 and the plurality of second flow channels 38 are calculated through calculations performed by a computer device using Equations (1) and (2). The information regarding the flow rate distribution in the first flow channel portion 34 and the second flow channel portion 35 is acquired based on the calculated pressure losses in the plurality of first flow channel portions 34 and second flow channel portions 35.

The information regarding the flow rate distribution of the fluid in the plurality of first flow channels 36 and the plurality of second flow channels 38 may be acquired through simulation analysis using the computer device.

In the step S22 of determining the shapes of the first flow channel 36 and the second flow channel 38, the shapes of the first flow channel 36 and the second flow channel 38 are determined such that the flow resistance is constant, based on the information regarding the flow rate distribution of the first fluid F1 among the plurality of first flow channels 36 and the flow rate distribution of the second fluid F2 among the plurality of second flow channels 38, which are acquired in the step S21. In this case, in a case where the flow rate distribution of the first fluid F1 among the plurality of first flow channels 36 is uneven beyond a determined range, the first flow rate distribution adjustment portion 70A determines the shape of the first flow channel 36 in a state in which the flow rate distribution of the first fluid F1 in the plurality of first flow channels 36 has been adjusted. In a case where the flow rate distribution of the second fluid F2 among the plurality of second flow channels 38 is uneven beyond a determined range, the second flow rate distribution adjustment portion 70B determines the shape of the second flow channel 38 in a state in which the flow rate distribution of the second fluid F2 in the plurality of second flow channels 38 has been adjusted. Specifically, the shapes of the first flow channel 36 and the second flow channel 38 are determined in a state in which at least one of the diameter, the curvature, and the flow channel surface roughness of the flow channel has been changed for a part of the plurality of first flow channels 36 and second flow channels 38 as the first flow rate distribution adjustment portion 70A and the second flow rate distribution adjustment portion 70B.

In the step S23 of forming the first flow channel portion 34 and the second flow channel portion 35, the first flow channel portion 34 and the second flow channel portion 35 are formed based on the shapes of the first flow channel 36 and the second flow channel 38 determined in the step S22. In the second embodiment, the plurality of first flow channels 36 (361 to 363) and second flow channels 38 (381 to 383) are formed in accordance with the shapes determined for each of the laminates 311*a* to 311*d*. In this case, the diameter, the curvature, the flow channel surface roughness, or the like of the flow channel is formed to be partially different depending on the laminates 311*a* to 311*d* to be formed and the positions where the laminates 311*a* to 311*d* are formed. After that, the laminates 311*a* to 311*d* are stacked in the first direction D1, thereby forming the header body 31.

In the step S24 of forming the first external pipe connecting portion 32 and the second external pipe connecting portion 33, the first external pipe connecting portion 32 and the second external pipe connecting portion 33 are each formed in a predetermined shape.

In the step S25 of manufacturing the header member 30Q, the first flow channel portion 34 and the second flow channel portion 35 formed in the step S23, and the first external pipe connecting portion 32 and the second external pipe connecting portion 33 formed in the step S24 are connected and fixed. As a result, the header member 30Q configuring the first header 3A and the second header 3B is manufactured.

Actions and Effects

With the header member 30Q having the above-described configuration, the first flow rate distribution adjustment portion 70A and the second flow rate distribution adjustment portion 70B can adjust the flow rate distribution of the first fluid F1 in the plurality of first flow channels 36 and the flow rate distribution of the second fluid F2 in the plurality of second flow channels 38. As a result, in a process in which the plurality of first flow channels 36 and the plurality of second flow channels 38 are connected in a stepwise manner such that the number thereof gradually decreases, it is possible to appropriately adjust the flow rate distribution due to differences in the flow resistance caused by differences and the like in the flow channel length in each flow channel section.

In addition, in the first flow rate distribution adjustment portion 70A and the second flow rate distribution adjustment portion 70B, at least one of the diameter, the curvature, and the flow channel surface roughness of the flow channel is changed for the plurality of first flow channels 36 and the plurality of second flow channels 38. The diameter, the curvature, and the flow channel surface roughness of the flow channel contribute to the pressure loss in each flow channel. Therefore, by changing at least one of the diameter, the curvature, and the flow channel surface roughness of the flow channel, it is possible to finely adjust the pressure loss in each flow channel. As a result, the flow resistance of the first flow channel 36 and the second flow channel 38 in each of the flow channel sections R1 to R4 can be made constant, thereby achieving a uniform flow rate distribution of the first fluid F1 and the second fluid F2 in the heat exchanger 2.

Further, in the above-described method S20 for manufacturing the header member 30Q, it is possible to manufacture the header members 30P and 30Q including the first flow channels 36 and the second flow channels 38 whose shapes are determined such that the flow resistance is constant, based on the information regarding the flow rate distribution of the first fluid F1 in the first flow channel portion 34 and the flow rate distribution of the second fluid F2 in the second flow channel portion 35. Therefore, it is possible to provide the header members 30P and 30Q that branch or converge the first fluid F1 and the second fluid F2 with a simple configuration without mixing the first fluid F1 and the second fluid F2 with respect to the heat exchanger 2 having a configuration in which the plurality of first heat transfer pipes 21 and the plurality of second heat transfer pipes 22 are disposed to be adjacent to each other.

Modification Example of Second Embodiment

In the above-described embodiment, the first flow rate distribution adjustment portion 70A and the second flow rate distribution adjustment portion 70B are configured to change at least one of the diameter, the curvature, and the flow channel surface roughness of the flow channel for the plurality of first flow channels 36 and the plurality of second flow channels 38, but the forms of the first flow rate distribution adjustment portion 70A and the second flow rate distribution adjustment portion 70B are not limited to being a part of the flow channels in this manner.

Figure 15:
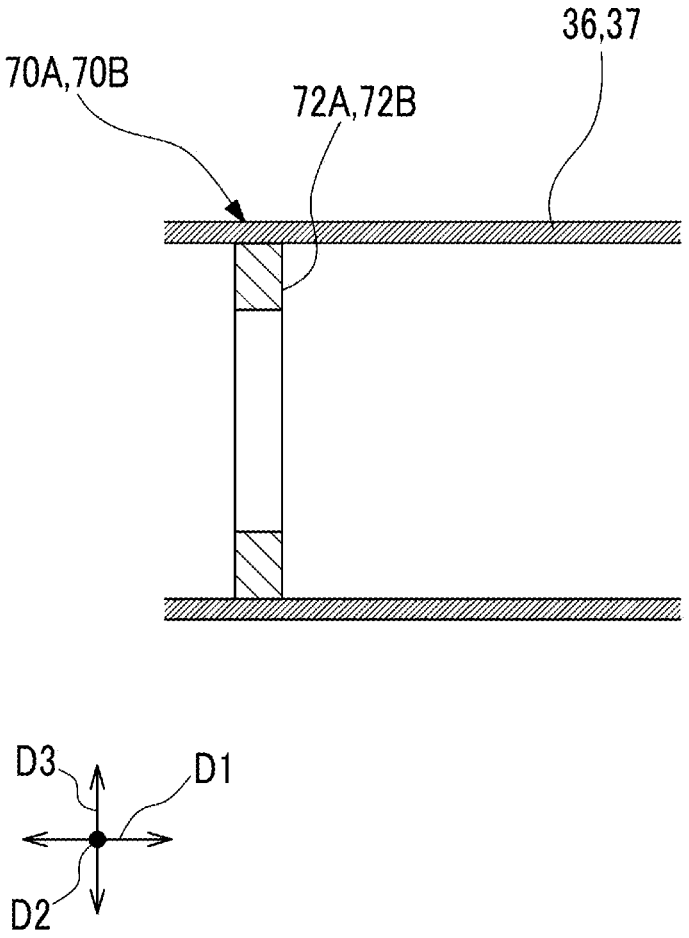
FIG. 15 is a cross-sectional view showing configurations of a first flow rate distribution adjustment portion and a second flow rate distribution adjustment portion provided in a header member according to a modification example of the second embodiment of the present disclosure.

The first flow rate distribution adjustment portion 70A and the second flow rate distribution adjustment portion 70B may be separate members from the plurality of first flow channels 36 and the plurality of second flow channels 38. For example, as shown in FIG. 15, the first flow rate distribution adjustment portion 70A may include an orifice 72A that narrows the flow channel cross-sectional area and that is provided in at least one of the first flow channels 36. Similarly, the second flow rate distribution adjustment portion 70B may include an orifice 72B that narrows the flow channel cross-sectional area and that is provided in at least one of the second flow channels 38.

By providing the orifices 72A and 72B in at least one of the first flow channels 36 and at least one of the second flow channels 38, the flow resistance in a part of the plurality of first flow channels 36 and second flow channels 38 can be increased. Consequently, regardless of the shapes of the first flow channel 36 and the second flow channel 38, the flow rate distribution of the first fluid F1 and the second fluid F2 in the plurality of first flow channels 36 and second flow channels 38 can be adjusted. Additionally, the flow rate distribution can be adjusted even in a case where the flow rates of the first fluid F1 and the second fluid F2 in the plurality of first flow channels 36 and second flow channels 38 change.

In the above-described second embodiment, the first flow rate distribution adjustment portion 70A and the second flow rate distribution adjustment portion 70B are configured to adjust the flow rate distribution such that the flow resistance of the first flow channel 36 and the second flow channel 38 in each of the flow channel sections R1 to R4 is constant, but the present disclosure is not limited to making the flow resistance constant. As the adjustment of the flow rate distribution of the first fluid F1 and the second fluid F2 by the first flow rate distribution adjustment portion 70A and the second flow rate distribution adjustment portion 70B, the flow rate distribution of the first fluid F1 and the second fluid F2 may be brought closer to a preset distribution.

Other Embodiments

The embodiments of the present disclosure have been described in detail hereinabove with reference to the drawings; however, specific configurations are not limited to the embodiments, and design changes and the like within a scope that does not deviate from the gist of the present disclosure are also included.

In the above-described embodiment, the procedures of the methods S10 and S20 for manufacturing the header members 30P and 30Q are shown, but the order thereof can be appropriately changed.

The first flow channel 36 and the second flow channel 38 are not limited to the forms of the present embodiment. For example, the first flow channel 36 and the second flow channel 38 may be formed by pipe bodies disposed in the header body 31 or may be formed separately from the header body 31. That is, the first flow channel portion 34 and the second flow channel portion 35 are not limited to being configured by the laminates 311*a* to 311*d*. The first flow channel portion 34 and the second flow channel portion 35 may be configured by a single block-shaped member.

In addition, in the present embodiment, the number of the plurality of flow channel sections disposed is four; however, the number of flow channel sections is not limited to four and may be three or fewer or five or more.

Further, in each of the plurality of flow channel sections R1 to R4, the flow channel cross-sectional areas of the plurality of first flow channels 36 and the plurality of second flow channels 38 may be all different or conversely, may be all the same, or only a part may be the same.

APPENDIX

The header members 30P and 30Q, the heat exchanger unit 1A, and the methods S10 and S20 for manufacturing the header members 30P and 30Q described in each of the embodiments are understood as follows, for example.

(1) The header member 30P, 30Q according to a first aspect is the header member 30P, 30Q that is attached to the heat exchanger 2 in which the plurality of first heat transfer pipes 21 through which the first fluid F1 flows and the plurality of second heat transfer pipes 22 through which the second fluid F2 different from the first fluid F1 flows are disposed to be adjacent to each other, the header member including: one first external pipe connecting portion 32 that is disposed at a position away from the end portion of the heat exchanger 2 and to which the first external pipe 8A, 8B for supplying or discharging the first fluid F1 to or from the heat exchanger 2 is connectable; the first flow channel portion 34 that is disposed between the end portions of the plurality of first heat transfer pipes 21 and the first external pipe connecting portion 32; one second external pipe connecting portion 33 that is disposed at a position away from the end portion of the heat exchanger 2 and to which the second external pipe 9A, 9B for supplying or discharging the second fluid F2 to or from the heat exchanger 2 is connectable; and the second flow channel portion 35 that is disposed between the end portions of the plurality of second heat transfer pipes 22 and the second external pipe connecting portion 33, in which the first flow channel portion 34 includes the plurality of first flow channels 36 coupled respectively to the plurality of first heat transfer pipes 21, the plurality of first flow channels 36 are sequentially connected in a stepwise manner and are connected to the one first external pipe connecting portion 32, the second flow channel portion 35 includes the plurality of second flow channels 38 coupled respectively to the plurality of second heat transfer pipes 22 and formed independently of the plurality of first flow channels 36, and the plurality of second flow channels 38 are sequentially connected in a stepwise manner and are connected to the one second external pipe connecting portion 33.

Examples of the first external pipe connecting portion 32 and the second external pipe connecting portion 33 include a coupler and a screw joint.

In the header member 30P, 30Q, the plurality of first flow channels 36 and the plurality of second flow channels 38 that are sequentially connected in a stepwise manner are connected to the one first external pipe connecting portion 32 and the one second external pipe connecting portion 33 without allowing the fluid flowing inside to mix. As a result, it is possible to branch or converge the first fluid F1 and the second fluid F2 with a simple configuration without mixing the first fluid F1 and the second fluid F2 with respect to the heat exchanger 2 having a configuration in which the plurality of first heat transfer pipes 21 and the plurality of second heat transfer pipes 22 are disposed to be adjacent to each other.

(2) The header member 30P, 30Q according to a second aspect is the header member 30P, 30Q according to (1), in which the first flow channel portion 34 and the second flow channel portion 35 include the plurality of flow channel sections R1 to R4 in which the number of first flow channels 36 and second flow channels 38 arranged in the second direction D2, which intersects the first direction D1 in which the first heat transfer pipe 21 and the second heat transfer pipe 22 extend, decreases as a distance from the heat exchanger 2 increases in the first direction D1, and at least one first flow channel connecting portion 37 that is disposed between the adjacent flow channel sections R1 to R4 and that connects the plurality of first flow channels 36 which are close to the heat exchanger 2 and one first flow channel 36 which is close to the first external pipe connecting portion 32 in the first direction D1, and at least one second flow channel connecting portion 39 that is disposed between the adjacent flow channel sections R1 to R4 and that connects the plurality of second flow channels 38 which are close to the heat exchanger 2 and one second flow channel 38 which is close to the second external pipe connecting portion 33 in the first direction D1 are provided.

Consequently, since the first flow channel connecting portion 37 and the second flow channel connecting portion 39 are disposed between the adjacent flow channel sections R1 to R4, the number of the plurality of first flow channels 36 and the plurality of second flow channels 38 in each flow channel section gradually decreases as the distance from the heat exchanger 2 increases in the flow channel sections R1 to R4 close to the heat exchanger 2 and the flow channel sections R1 to R4 close to the first external pipe connecting portion 32 in the first direction D1. As a result, it is possible to branch or converge the first flow channel 36 and the second flow channel 38 with a simple configuration with respect to the heat exchanger 2.

(3) The header member 30P, 30Q according to a third aspect is the header member 30P, 30Q according to (2), in which the first flow channel connecting portion 37 connects at least two first flow channels 36 disposed at positions closest to each other when viewed from the first direction D1 in the adjacent flow channel sections R1 to R4, and the second flow channel connecting portion 39 connects at least two second flow channels 38 disposed at positions closest to each other when viewed from the first direction D1 in the adjacent flow channel sections R1 to R4.

Consequently, the first flow channel connecting portion 37 and the second flow channel connecting portion 39 connect at least two first flow channels 36 and at least two second flow channels 38, which are disposed at positions closest to each other when viewed from the first direction D1, in the adjacent flow channel sections R1 to R4. As a result, the flow channel lengths of the first flow channel connecting portion 37 and the second flow channel connecting portion 39 can be shortened. Therefore, the overall flow channel length in the first flow channel portion 34 and the second flow channel portion 35 can also be shortened. Accordingly, it is possible to suppress the pressure loss in the first flow channel portion 34 and the second flow channel portion 35.

(4) The header member 30P, 30Q according to a fourth aspect is the header member 30P, 30Q according to (2) or (3), in which the first flow channel portion 34 and the second flow channel portion 35 are configured by the plurality of laminates 311*a* to 311*d* laminated in the first direction D1, and the plurality of laminates 311*a* to 311*d* include the first flow channel connecting portion 37 and the second flow channel connecting portion 39.

As a result, by simply stacking the plurality of laminates 311*a* to 311*d*, it is possible to easily achieve a configuration in which the first flow channels 36 and the second flow channels 38 are sequentially connected by the first flow channel connecting portion 37 and the second flow channel connecting portion 39.

(5) The header member 30P, 30Q according to a fifth aspect is the header member 30P, 30Q according to (2) or (3), in which, in the adjacent flow channel sections R1 to R4, the flow channel cross-sectional areas of one first flow channel 36 and one second flow channel 38, which are close to the first external pipe connecting portion 32, are larger than the flow channel cross-sectional areas of the plurality of first flow channels 36 and second flow channels 38, which are close to the heat exchanger 2 in the first direction D1.

Consequently, the pressure loss in a case where the plurality of first flow channels 36 and the plurality of second flow channels 38 merge with or branch from one first flow channel 36 and one second flow channel 38 is suppressed. Therefore, it is possible to suppress a decrease in the flow efficiency of the first fluid F1 and the second fluid F2 in the first flow channel portion 34 and the second flow channel portion 35.

(6) The header member 30Q according to a sixth aspect is the header member 30Q according to any one of (2) to (4), in which the first flow rate distribution adjustment portion 70A that is disposed in the first flow channel portion 34 and that adjusts the flow rate distribution of the first fluid F1 in the plurality of first flow channels 36, and the second flow rate distribution adjustment portion 70B that is disposed in the second flow channel portion 35 and that adjusts the flow rate distribution of the second fluid F2 in the plurality of second flow channels 38 are further provided.

Consequently, the flow rate distribution of the first fluid F1 in the plurality of first flow channels 36 and the flow rate distribution of the second fluid F2 in the plurality of second flow channels 38 can be adjusted. As a result, in a process in which the plurality of first flow channels 36 and the plurality of second flow channels 38 are connected in a stepwise manner such that the number thereof gradually decreases, it is possible to appropriately adjust the flow rate distribution due to differences in the flow resistance caused by differences and the like in the flow channel length.

(7) The header member 30Q according to a seventh aspect is the header member 30Q according to (6), in which the first flow rate distribution adjustment portion 70A changes at least one of the diameter, the curvature, and the flow channel surface roughness of the flow channel for the plurality of first flow channels 36 such that the flow resistance of the first flow channels 36 in the flow channel sections R1 to R4 is constant, and the second flow rate distribution adjustment portion 70B changes at least one of the diameter, the curvature, and the flow channel surface roughness of the flow channel for the plurality of second flow channels 38 such that the flow resistance of the second flow channels 38 in the flow channel sections R1 to R4 is constant.

The diameter, the curvature, and the flow channel surface roughness of the flow channel contribute to the pressure loss in each flow channel. Therefore, by changing at least one of the diameter, the curvature, and the flow channel surface roughness of the flow channel, it is possible to finely adjust the pressure loss in each flow channel. As a result, the flow resistance of the first flow channel 36 and the second flow channel 38 in each of the flow channel sections R1 to R4 can be made constant, thereby achieving a uniform flow rate distribution of the first fluid F1 and the second fluid F2 in the heat exchanger 2.

(8) The header member 30Q according to an eighth aspect is the header member 30Q according to (6) or (7), in which the first flow rate distribution adjustment portion 70A and the second flow rate distribution adjustment portion 70B include the orifices 72A and 72B that narrow the flow channel cross-sectional areas, the orifices being provided in at least one of the first flow channels 36 and at least one of the second flow channels 38, respectively.

Consequently, regardless of the shapes of the first flow channel 36 and the second flow channel 38, the flow rate distribution of the first fluid F1 and the second fluid F2 in the plurality of first flow channels 36 and second flow channels 38 can be adjusted. Additionally, the flow rate distribution can be adjusted even in a case where the flow rates of the first fluid F1 and the second fluid F2 in the plurality of first flow channels 36 and second flow channels 38 change.

(9) The heat exchanger unit 1A according to a ninth aspect includes: the heat exchanger 2 that includes the plurality of first heat transfer pipes 21 through which the first fluid F1 flows and the plurality of second heat transfer pipes 22 through which the second fluid F2 flows; and the header member 30P, 30Q according to any one of (1) to (8) that is disposed at at least one end portion of the heat exchanger 2.

As a result, it is possible to provide the heat exchanger unit 1A including the header member 30P, 30Q that branches or converges the first fluid F1 and the second fluid F2 with a simple configuration without mixing the first fluid F1 and the second fluid F2.

(10) The method S20 for manufacturing the header member 30Q according to a tenth aspect is the method S20 for manufacturing the header member 30Q according to any one of (1) to (8), including: a step S21 of acquiring information regarding the flow rate distribution of the first fluid F1 among the plurality of first flow channels 36 in the first flow channel portion 34 and the flow rate distribution of the second fluid F2 among the plurality of second flow channels 38 in the second flow channel portion 35; a step S22 of determining the shapes of the first flow channel 36 and the second flow channel 38 such that the flow resistance is constant, based on the acquired information regarding the flow rate distribution of the first fluid F1 among the plurality of first flow channels 36 and the flow rate distribution of the second fluid F2 among the plurality of second flow channels 38; a step S23 of forming the first flow channel portion 34 and the second flow channel portion 35 based on the determined shapes of the first flow channel 36 and the second flow channel 38; a step S24 of forming the first external pipe connecting portion 32 and the second external pipe connecting portion 33; and a step S25 of connecting the formed first external pipe connecting portion 32, first flow channel portion 34, second external pipe connecting portion 33, and second flow channel portion 35 to manufacture the header member 30Q.

As a result, it is possible to manufacture the header member 30Q including the first flow channels 36 and the second flow channels 38 whose shapes are determined such that the flow resistance is constant, based on the information regarding the flow rate distribution of the first fluid F1 in the first flow channel portion 34 and the flow rate distribution of the second fluid F2 in the second flow channel portion 35. Therefore, it is possible to provide the header member 30Q that branches or converges the first fluid F1 and the second fluid F2 with a simple configuration without mixing the first fluid F1 and the second fluid F2 with respect to the heat exchanger 2 having a configuration in which the plurality of first heat transfer pipes 21 and the plurality of second heat transfer pipes 22 are disposed to be adjacent to each other.

INDUSTRIAL APPLICABILITY

With the header member, the heat exchanger unit, and the method for manufacturing a header member of the present disclosure, it is possible to branch or converge the first fluid and the second fluid with a simple configuration without mixing the first fluid and the second fluid with respect to a heat exchanger having a configuration in which a plurality of first heat transfer pipes and a plurality of second heat transfer pipes are disposed to be adjacent to each other.

REFERENCE SIGNS LIST

1A, 1B: heat exchanger unit
2: heat exchanger
3A: first header
3B: second header
8A, 8B: first external pipe
9A, 9B: second external pipe
21: first heat transfer pipe
22: second heat transfer pipe
23: casing
30P, 30Q: header member
31: header body
32: first external pipe connecting portion
33: second external pipe connecting portion
34: first flow channel portion
35: second flow channel portion
36: first flow channel
361: primary first flow channel
362: secondary first flow channel
363: tertiary first flow channel
364: quaternary first flow channel
37: first flow channel connecting portion
371: primary first flow channel connecting portion
372: secondary first flow channel connecting portion
373: tertiary first flow channel connecting portion
38: second flow channel
381: primary second flow channel
382: secondary second flow channel
383: tertiary second flow channel
384: quaternary second flow channel
39: second flow channel connecting portion
391: primary second flow channel connecting portion
392: secondary second flow channel connecting portion
393: tertiary second flow channel connecting portion
70A: first flow rate distribution adjustment portion
70B: second flow rate distribution adjustment portion
72A, 72B: orifice
311*a* to 311*d*: laminate
D1: first direction
D2: second direction
D3: third direction
F1: first fluid
F2: second fluid
R1 to R4: flow channel section
S10, S20: method for manufacturing header member
S21: step of acquiring information regarding flow rate distribution in first flow channel portion and second flow channel portion
S12, S22: step of determining shapes of first flow channel and second flow channel
S13, S23: step of forming first flow channel portion and second flow channel portion
S14, S24: step of forming first external pipe connecting portion and second external pipe connecting portion
S15, S25: step of manufacturing header member

The invention claimed is:

1. A header member that is attached to a heat exchanger in which a plurality of first heat transfer pipes through which a first fluid flows and a plurality of second heat transfer pipes through which a second fluid different from the first fluid flows are disposed to be adjacent to each other, the header member comprising:

one first external pipe connecting portion that is disposed at a position away from an end portion of the heat exchanger and to which a first external pipe for supplying or discharging the first fluid to or from the heat exchanger is connectable;

a first flow channel portion that is disposed between end portions of the plurality of first heat transfer pipes and the first external pipe connecting portion;

one second external pipe connecting portion that is disposed at a position away from the end portion of the heat exchanger and to which a second external pipe for supplying or discharging the second fluid to or from the heat exchanger is connectable; and a second flow channel portion that is disposed between end portions of the plurality of second heat transfer pipes and the second external pipe connecting portion, wherein the first flow channel portion includes a plurality of first flow channels coupled respectively to the plurality of first heat transfer pipes, the plurality of first flow channels are sequentially connected in a stepwise manner and are connected to the one first external pipe connecting portion, the second flow channel portion includes a plurality of second flow channels coupled respectively to the plurality of second heat transfer pipes and formed independently of the plurality of first flow channels, the plurality of second flow channels are sequentially connected in a stepwise manner and are connected to the one second external pipe connecting portion, the first flow channel portion and the second flow channel portion include a plurality of flow channel sections in which the number of first flow channels and second flow channels arranged in a second direction, which intersects a first direction in which the first heat transfer pipe and the second heat transfer pipe extend, decreases as a distance from the heat exchanger increases in the first direction, at least one first flow channel connecting portion that is disposed between adjacent flow channel sections and that connects a plurality of the first flow channels which are close to the heat exchanger and one first flow channel which is close to the first external pipe connecting portion in the first direction, and at least one second flow channel connecting portion that is disposed between adjacent flow channel sections and that connects a plurality of the second flow channels which are close to the heat exchanger and one second flow channel which is close to the second external pipe connecting portion in the first direction are provided, the first flow channel portion and the second flow channel portion are configured to form by holes penetrating through insides a plurality of laminates laminated in the first direction, the plurality of laminates are fixed to each other in a state of being adjacent in the first direction, and in the plurality of laminates, the first flow channel connecting portion and the second flow channel connecting portion are formed within the plurality of laminates so as to extend along a virtual plane extending in a second direction orthogonal to the first direction and a third direction orthogonal to both the first direction and the second direction.

2. The header member according to claim 1, wherein the first flow channel connecting portion connects at least two first flow channels disposed at positions closest to each other when viewed from the first direction in the adjacent flow channel sections, and the second flow channel connecting portion connects at least two second flow channels disposed at positions closest to each other when viewed from the first direction in the adjacent flow channel sections.

3. The header member according to claim 1, wherein, in the adjacent flow channel sections, flow channel cross-sectional areas of one first flow channel and one second flow channel, which are close to the first external pipe connecting portion, are larger than flow channel cross-sectional areas of one first flow channel and one second flow channel, which are close to the heat exchanger in the first direction.

4. The header member according to claim 1, further comprising:

a first flow rate distribution adjustment portion that is disposed in the first flow channel portion and that adjusts a flow rate distribution of the first fluid in the plurality of first flow channels; and a second flow rate distribution adjustment portion that is disposed in the second flow channel portion and that adjusts a flow rate distribution of the second fluid in the plurality of second flow channels.

5. The header member according to claim 4, wherein the first flow rate distribution adjustment portion changes at least one of a diameter, a curvature, and a flow channel surface roughness of the flow channel for the plurality of first flow channels such that flow resistance of the first flow channels in the flow channel section is constant, and the second flow rate distribution adjustment portion changes at least one of a diameter, a curvature, and a flow channel surface roughness of the flow channel for the plurality of second flow channels such that flow resistance of the second flow channels in the flow channel section is constant.

6. The header member according to claim 4, wherein the first flow rate distribution adjustment portion and the second flow rate distribution adjustment portion include orifices that narrow flow channel cross-sectional areas, the orifices being provided in at least one of the first flow channels and at least one of the second flow channels, respectively.

7. A heat exchanger unit comprising:

a heat exchanger that includes a plurality of first heat transfer pipes through which a first fluid flows and a plurality of second heat transfer pipes through which a second fluid flows; and the header member according to claim 1 that is disposed at at least one end portion of the heat exchanger.

8. A method for manufacturing the header member according to claim 1, comprising:

a step of acquiring information regarding a flow rate distribution of the first fluid among the plurality of first flow channels in the first flow channel portion and a flow rate distribution of the second fluid among the plurality of second flow channels in the second flow channel portion;

a step of determining shapes of the first flow channel and the second flow channel such that flow resistance is constant, based on the acquired information regarding the flow rate distribution of the first fluid among the plurality of first flow channels and the flow rate distribution of the second fluid among the plurality of second flow channels;

a step of forming the first flow channel portion and the second flow channel portion based on the determined shapes of the first flow channel and the second flow channel;

a step of forming the first external pipe connecting portion and the second external pipe connecting portion; and a step of connecting the formed first external pipe connecting portion, first flow channel portion, second external pipe connecting portion, and second flow channel portion to manufacture the header member.

* * * * *